US007416828B2

(12) United States Patent
Kurosu

(10) Patent No.: US 7,416,828 B2
(45) Date of Patent: Aug. 26, 2008

(54) DEVELOPING METHOD, DEVELOPING DEVICE, AND PROCESS CARTRIDGE AND IMAGE FORMING APPARATUS USING THE DEVELOPING DEVICE

(75) Inventor: Hisao Kurosu, Yokohama (JP)

(73) Assignee: Ricoh Company Limited, Tokyo (JP)

( * ) Notice: Subject to any disclaimer, the term of this patent is extended or adjusted under 35 U.S.C. 154(b) by 522 days.

(21) Appl. No.: 11/227,494

(22) Filed: Sep. 16, 2005

(65) Prior Publication Data

US 2006/0063093 A1 Mar. 23, 2006

(30) Foreign Application Priority Data

Sep. 17, 2004 (JP) ..... 2004-271710
Mar. 18, 2005 (JP) ..... 2005-079428
Sep. 7, 2005 (JP) ..... 2005-259434

(51) Int. Cl.
*G03G 9/08* (2006.01)

(52) U.S. Cl. ..... 430/122.2; 430/122.7; 399/267

(58) Field of Classification Search ..... 430/122.2, 430/122.7; 399/267
See application file for complete search history.

(56) References Cited

U.S. PATENT DOCUMENTS 6,385,423 B1 5/2002 Kai
6,708,015 B2 3/2004 Kurosu et al.
6,760,561 B2 7/2004 Kurosu
6,882,818 B2 4/2005 Kurosu
2003/0049053 A1* 3/2003 Kurosu ..... 399/267
2004/0126145 A1 7/2004 Kurosu
2004/0229152 A1 11/2004 Kurosu

FOREIGN PATENT DOCUMENTS

JP 6-194961 7/1994
JP 8-30103 2/1996
JP 8-146668 6/1996
JP 8-328386 12/1996
JP 2000-305360 11/2000
JP 2004-77635 3/2004

* cited by examiner

*Primary Examiner*—Mark A Chapman
(74) *Attorney, Agent, or Firm*—Oblon, Spivak, McClelland, Maier & Neustadt, P.C.

(57) ABSTRACT

A developing method including forming a magnetic brush of a two component developer comprising a toner and a magnetic carrier; and developing an electrostatic latent image with the magnetic brush, wherein the ratio ($A_{nc}/A_t$) of the area ($A_{nc}$) of the carrier-noncontact portion to the area of the development portion in which the electrostatic latent image can be developed by the magnetic brush is from 0.30 to 0.70, and the ratio (Avc/vs) of the average moving velocity (Avc) of carrier particles contacting the image bearing member to the moving velocity (vs) of the surface of the developer bearing member is from 0.8 to 1.1. Alternatively, it is possible that the ratio ($A_{nc}/A_t$) is not greater than 0.50 and the ratio (Avc/vs) is from 0.3 to 1.1.

33 Claims, 17 Drawing Sheets

DEVELOPING METHOD, DEVELOPING DEVICE, AND PROCESS CARTRIDGE AND IMAGE FORMING APPARATUS USING THE DEVELOPING DEVICE

BACKGROUND OF THE INVENTION

1. Field of the Invention

The present invention relates to a developing method for forming an image using a developer including a toner and a magnetic carrier. In addition, the present invention also relates to a developing device, and a process cartridge and an image forming apparatus including a developing device.

2. Discussion of the Background

In recent years, image forming apparatus such as copiers and laser printers are required to produce high quality images while having a good combination of durability and stability. Specifically, image forming apparatus are required to stably produce high quality images for a long period of time even when environmental conditions are changed.

On the other hand, two component developing methods have been broadly used for electrophotographic image forming apparatus. Two component developing methods typically include the following steps:

(1) forming a magnetic brush of a two component developer including a toner and a magnetic carrier on a developer bearing member (such as a developing sleeve) by means of the magnetic poles of a magnet included in the developer bearing member; and (2) developing an electrostatic latent image formed on an image bearing member with the magnetic brush in a developing region in which the image bearing member and the developer bearing member are opposed to each other while applying a developing bias to the developer bearing member.

Such two component developing methods have an advantage in that color images can be easily produced.

In the two component developing methods, the developer is fed to the developing region by rotation of the developing sleeve. In this regard, when the developer is fed to the developing region, particles of the magnetic carrier in the developer layer on the developing sleeve are gathered by means of the magnetic pole (i.e., the developing pole) while the carrier particles accompany the toner particles, resulting in formation of the magnetic brush.

As described in published unexamined Japanese patent application No. (hereinafter referred to as JP-A) 06-194961, an alternate electric field such that an electric field which causes toner particles to move toward the image bearing member and another electric field which causes the toner particles to move toward the developer bearing member are alternately applied is typically used as the developing bias. By applying such an alternate electric field, a high developability can be imparted to the developing device, and images having high image density can be stably produced. In addition, even when the charge quantity distribution of the toner used for the two component developer is changed after long repeated use, images having high image density can be stably produced. Further, even when light half tone electrostatic images (i.e., half tone electrostatic images corresponding to half tone toner images having a low image density) are developed, proper amounts of toner particles can be adhered to the half tone electrostatic images by applying such an alternate electric field. Thus, by using such an alternate electric field, not only high developing ability can be imparted to the developing device but also half tone electrostatic images can be faithfully reproduced. Therefore, the developing method using an alternate electric field is typically used for color image forming apparatus. In addition, when the developing method is used for monochrome image forming apparatus, half tone images with little granularity (i.e., half tone images having good evenness) and solid images with good evenness can be produced. Therefore, the developing method is suitable for not only color image forming apparatus but also monochrome image forming apparatus.

However, when an alternate electric field is used as the developing bias, a problem which occurs is that a white ring image is formed in the resultant toner image due to occurrence of discharging in a portion of an electrostatic latent image corresponding to a half tone toner image having a high image density, which is caused by local increase of electric field strength in a magnetic brush having a dense portion and a thin portion. In order to avoid such a white ring image problem, the resistance of the carrier is preferably increased. However, even when the resistance of the carrier is optimized, occurrence of discharging cannot be prevented if a layer (such as a resin layer) formed on the carrier particles has uneven thickness. This is because the portions of the carrier particles having a thin resin layer thereon cause breakdown. Thus, in order to produce images having good evenness, various conditions (such as the resistance of the carrier and thickness of the coated layer formed on the carrier) have to be controlled.

In attempting to prevent formation of granular images (i.e., images with poor evenness) even when the developing method using an alternate electric field is used, various studies have been made. It is well known as a result of the studies that formation of granular images can be prevented by accelerating rearrangement of toner particles when the toner particles are used for developing an electrostatic image.

However, the developing methods using an alternate electric field have the following drawbacks:

(1) the maximum value of the electric field is relatively large compared to a case where a direct electric field is formed, and thereby a problem in that carrier particles are adhered to electrostatic latent images is easily caused; and (2) an additional power source is necessary for forming an alternate electric field, and thereby the manufacturing costs of the developing device increase.

Therefore, various studies have been made for preventing occurrence of granular images even when a direct electric field is used as the developing bias.

It is well known as a result of various studies that granular images are formed because a thin magnetic brush is formed in the developing region. In attempting to prevent formation of such granular images (i.e., to produce high quality images), JP-A 08-146668 discloses a developing method in which the volume ratio of the carrier particles included in the magnetic brush in the developing region is specified. However, as a result of the present inventor's study, it is found that the granularity of images changes even when the volume ratio of carrier particles in a developing region is controlled to be uniform.

Because of these reasons, a need exists for a developing method, a developing device and an image forming apparatus by which high quality images with little granularity and good dot reproducibility can be produced.

SUMMARY OF THE INVENTION

According to an aspect of the present invention, a developing method is provided. The developing method includes:

forming a magnetic brush of a two component developer including a toner and a magnetic carrier so as to be borne on a developer bearing member by means of magnetic poles of a magnet fixed in the developer bearing member; and developing an electrostatic latent image on a surface of an image bearing member with the magnetic brush in a developing region, in which the image bearing member and the developer bearing member are opposed to each other, while moving the image bearing member and moving the magnetic brush by moving the developer bearing member without moving the magnet to form a toner image on the surface of the image bearing member, wherein the developing method satisfies the following relationships (1) and (2):

$$0.30 \leqq A_{nc}/A_t \leqq 0.70 \quad (1)$$

wherein $A_t$ represents the area of a development portion of the photoreceptor in the developing region, and $A_{nc}$ represents the area of a carrier-noncontact portion in the development portion with which the magnet carrier is not contacted when the development portion has no latent image, and $$0.8 \leqq Avc/vs \leqq 1.1 \quad (2)$$

wherein Avc represents the average moving velocity of carrier particles of the magnetic carrier in the magnetic brush, which carrier particles are contacted with the image bearing member, and vs represents the moving velocity of the surface of the developer bearing member. In this regard, the development portion is defined as a region within which any electrostatic latent image can be developed with the magnetic brush contacted with the image bearing member and the areas Anc and At are determined when no electrostatic image is formed on the development portion.

It is preferable that the carrier-noncontact portion includes separated plural regions and the ratio of the number of regions having an area not greater than $\pi (Dw/2)^2$ (Dw represents the weight average particle diameter of the magnetic carrier) to the total number of the plural regions is not less than 0.10 and/or the ratio of the number of regions having an area not greater than $5\pi (Dw/2)^2$ to the total number of the plural regions is not less than 0.30.

It is also preferable that not less than 90% in number of the carrier particles contacted with the image bearing member satisfies the following relationship (3):

$$vp \leqq vc \leqq 2vs \quad (3)$$

wherein vp represents the moving velocity of the surface of the image bearing member, vc represents the moving velocity of the carrier particles contacting the image bearing member, and vs represents the moving velocity of the surface of the developer bearing member.

It is preferable that not less than 80% in number of the carrier particles contacted with the image bearing member satisfies the following relationship (4):

$$0.625 \leqq vc/vs \leqq 1.5 \quad (4).$$

It is preferable that the magnetic carrier includes a core material and a resin layer formed on the surface of the core material, and has a weight average particle diameter of from 25 to 45 μm. In addition, it is preferable that magnetic carrier includes carrier particles having a particle diameter less than 44 μm in an amount of not less than 70% by weight, carrier particles having a particle diameter not less than 62 μm in an amount of less than 1% by weight, and carrier particles having a particle diameter less than 22 μm in an amount of not greater than 7% by weight.

It is preferable that the carrier has a magnetization of from 70 $A \cdot m^2/kg$ to 100 $A \cdot m^2/kg$ at a magnetic field of $1 \times 10^6/4\pi$ [A/m].

It is preferable that the magnet has a magnetic pole facing the developing region and the magnetic pole has a magnetic flux density of from 60 mT to 120 mT in the normal line direction at the surface of the magnetic pole. The magnet is preferably fixed such that the normal line of the magnetic pole at the surface thereof is different from the common normal line of the image bearing member and the developer bearing member by an angle of from 3° to 7° in a direction opposite to the moving direction of the image bearing member.

It is preferable that the ratio (vs/vp) of the linear velocity (vs) of the surface of the developer bearing member to the linear velocity (vp) of the surface of the image bearing member is from 1.5 to 2.5.

It is preferable that developing process is performed while applying either a direct electric field or an alternate electric field to the developer bearing member.

The developer bearing member preferably bears the developer in an amount of from 40 $mg/cm^2$ to 80 $mg/cm^2$ at the developing region.

The developer preferably includes the toner in an amount of from 5.0% by weight to 9.0% by weight based on the total weight of the developer. The toner preferably has an average charge quantity of from 15 μC/g to 60 μC/g in absolute value. The toner preferably has a weight average particle diameter of from 4.5 to 8.0 μm, and the ratio (Dw/Dn) of the weight average particle diameter (Dw) to the number average particle diameter (Dn) of the toner is preferably from 1.0 to 1.2.

Alternatively, the developing method may satisfy a combination of the following relationships (5) and (6) instead of the combination of relationships (1) and (2):

$$A_{nc}/A_t \leqq 0.50, \quad (5), \text{ and}$$

$$0.3 \leqq Avc/vs \leqq 1.1 \quad (6)$$

In this case, it is preferable that the carrier-noncontact portion includes separated plural regions and the ratio of the number of regions having an area not greater than $\pi (Dw/2)^2$ (Dw represents the weight average particle diameter of the carrier) to the total number of the plural regions is not less than 0.25 and/or the ratio of the number of regions having an area not greater than $1.5\pi (Dw/2)^2$ to the total number of the plural regions is not less than 0.45.

It is preferable that developing process is performed while applying a direct electric field or an alternate electric field to the image bearing member.

It is preferable that when a direct electric field is applied, the ratio (vs/vp) of the moving velocity (vs) of the developer bearing member to the moving velocity (vp) of the image bearing member is from 1.2 to 3. When an alternate electric field is applied, the ratio (vs/vp) is preferably from 2 to 3.

The developer bearing member preferably bears the developer in an amount of from 20 $mg/cm^2$ to 60 $mg/cm^2$ at the developing region.

Similarly to the first-mentioned developing method, it is preferable that the carrier particles have a resin layer on the surface thereof, and have a weight average particle diameter of from 25 μm to 45 μm. In addition, it is preferable that the magnetic carrier includes carrier particles having a particle diameter less than 44 μm in an amount of not less than 70% by weight, carrier particles having a particle diameter not less than 62 μm in an amount of less than 1% by weight, and carrier particles having a particle diameter less than 22 μm in an amount of not greater tan 7% by weight.

It is preferable that the carrier has a magnetization not less than 76 $A \cdot m^2/kg$ at a magnetic field of $1 \times 10^6/4\pi$ [A/m] and/or a volume resistivity not less than $1 \times 10^{12}$ Ω·cm.

The toner preferably includes a urea-modified polyester resin. In addition, the toner preferably has a weight average particle diameter of from 4 to 8 μm, and the ratio (Dw/Dn) of the weight average particle diameter (Dw) to the number average particle diameter (Dn) of the toner is preferably from 1 to 1.25. Further, the toner preferably has an average circularity of not less than 0.9 and less than 1.0.

Similarly to the first-mentioned developing method, it is preferable that the magnet has a magnetic pole facing the developing region and the magnetic pole has a magnetic flux density of from 60 mT to 120 mT in the normal line direction at the surface of the magnetic pole. The normal line of the magnetic pole at the surface thereof is different from the common normal line of the image bearing member and the developer bearing member by an angle of from 3° to 7° in a direction opposite to the moving direction of the image bearing member.

According to another aspect of the present invention, a developing device is provided. The developing device includes at least a developer bearing member and a developer including a toner and a magnetic carrier, wherein the developing device uses the first-mentioned or the second-mentioned developing method.

According to yet another aspect of the present invention, an image forming apparatus is provided. The image forming apparatus includes at least an image bearing member bearing an electrostatic latent image and the developing device configured to develop the electrostatic latent image with a developer, wherein the developing device is the developing device mentioned above.

According to a further aspect of the present invention, a process cartridge is provided. The process cartridge includes at least an image bearing member bearing an electrostatic latent image and the developing device configured to develop the electrostatic latent image with a developer including a toner and a magnetic carrier, wherein the developing device is the developing device mentioned above. The process cartridge can be detachably attached to an image forming apparatus.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
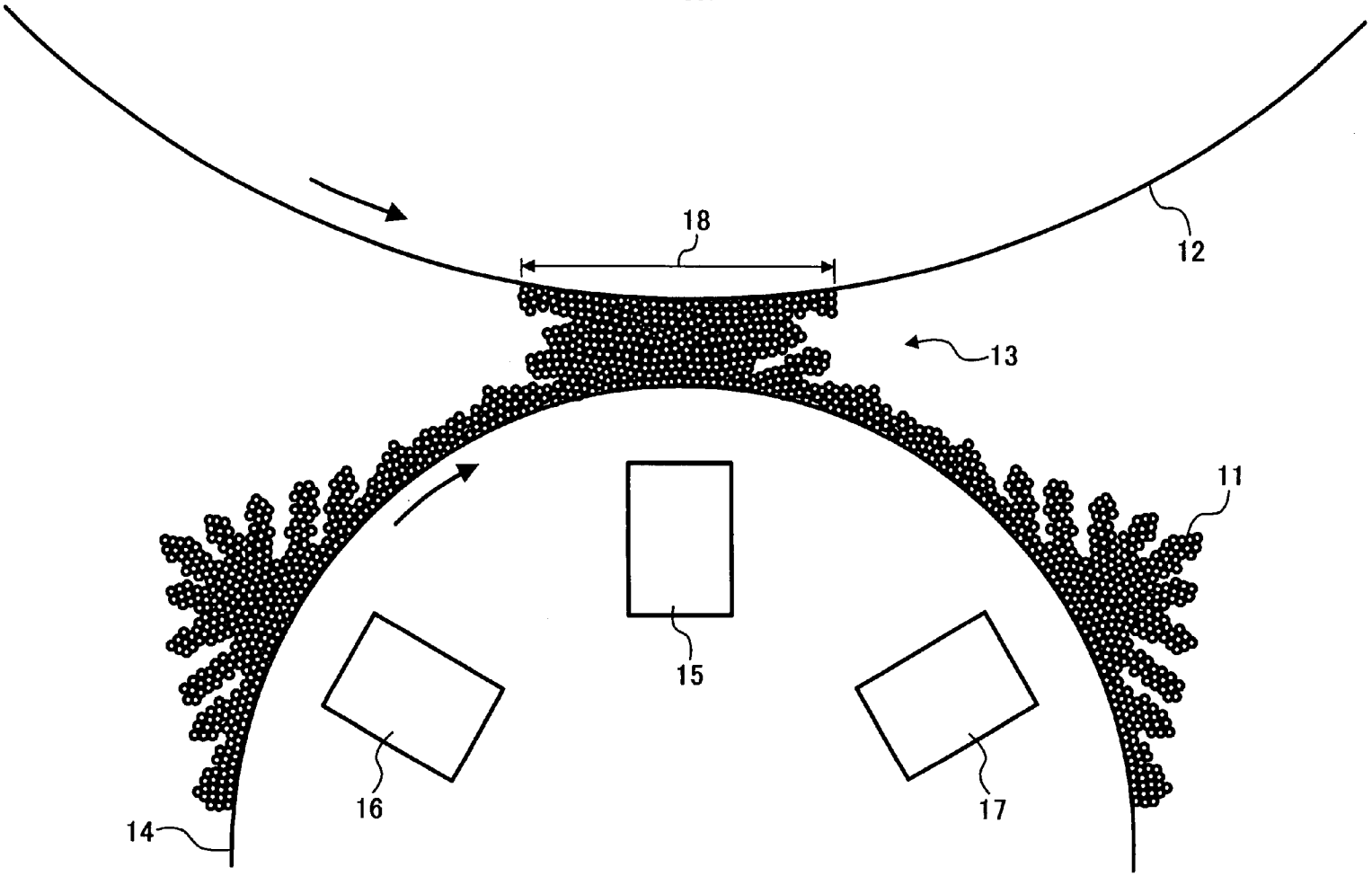
FIG. 1 is a schematic view for explaining the behavior of a magnetic brush in the developing region.

The present invention will be explained referring to examples and drawings.

In the developing method of the present invention, a developer including a toner and a magnetic carrier, which is borne on the surface of a developing sleeve (i.e., a developer bearing member) having a fixed magnet therein is fed by the developing sleeve to a photoreceptor (i.e., an image bearing member) to develop an electrostatic latent image formed on the surface of the photoreceptor. The shape of the photoreceptor is not particularly limited, but drum-shaped photoreceptors are preferably used. Hereinafter, examples in which a drum shaped photoreceptor is used will be explained.

The developing operation will be explained referring to FIG. 1. Numeral 11 denotes a magnetic brush of a developer including a magnetic carrier and a toner, which is borne on a surface of a developing sleeve 14 by means of magnets 15, 16 and 17 fixed in the developing sleeve 14. An electrostatic latent image located on a development portion 18 of a photoreceptor 12 is developed with the toner included in the magnetic brush in a developing region 13. However, in reality, part of toner particles or a large number of toner particles are released from the magnetic brush before the developing region 13, thereby developing the electrostatic latent image on the photoreceptor 12. In addition, edge portions of dot images and line images are fixed by the magnetic brush at the end portion of the developing region 13 (i.e., at a point in which the magnetic brush 11 is separated from the photoreceptor 12). In particular, when a toner having an average particle diameter of not greater than 5 μm is used, there is a case where latent dot or line images cannot be developed unless the magnetic brush 11 is contacted with or approached closely to the surface of the photoreceptor. Further, toner particles present in a bottom portion of the magnetic brush 11 (i.e., a portion of the magnetic brush near the surface of the developing sleeve 14) are hardly supplied to the latent image. Namely, toner particles present in a top portion of the magnetic brush 11 are adhered to the latent image. Part of the toner particles adhered to the latent image is returned to the top portion of the magnetic brush when the toner image on the photoreceptor 12 is rubbed by the magnetic brush 11. In order to form a toner image having good dot reproducibility, the top portion of the magnetic brush 11 contacting the photoreceptor 12 preferably achieves a state in which the carrier particles are uniformly arranged at a high density.

Among the magnets fixed in the developing sleeve 14, the magnet 15 serves as a main magnetic pole, and the magnets 16 and 17 serve as auxiliary magnetic poles. The auxiliary magnetic pole 16 which is ranged on an upstream side from the main magnetic pole 15 has a configuration such that a south pole and a north pole are alternately arranged. The auxiliary magnetic pole 17 which is arranged on a downstream side from the main magnetic pole 15 has a configuration such that poles having the same polarity are arranged side by side so that the developer is separated from the surface of the developing sleeve 14.

The present inventor discovers that the state of the magnetic brush contacting the photoreceptor can be well represented by a ratio of the area of a portion (hereinafter this portion is referred to as a carrier-noncontact portion of the photoreceptor) in a non image portion in the developing region 13, in which the magnetic carrier is not contacted with the photoreceptor, to the area or the development portion 18 of the photoreceptor in the developing region 13.

The carrier-noncontact portion means a region of the surface of the photoreceptor at which carrier particles are not present in the vicinity of the photoreceptor. The area of the carrier-noncontact portion can be determined by observing the developing region 13 from inside of the photoreceptor 12 and subjecting the image to a binarization treatment, which is explained below. In the developing region 13, the magnetic brush 11 has plural ears which are located at substantially an equal interval. Therefore, when the area of the carrier-noncontact portion is decreased, the tip portion of the magnetic brush achieves a state in which carrier particles are uniformly arranged at a high density.

In the present application, granularity of images is used to determine whether an image has grain-shaped unevenness. The granularity of an image is determined as follows.

(1) at first a half-tone image is read with a scanner to prepare a patch having an area of about 1 $cm^2$;

(2) the image is subjected to a Fourier transformation treatment to prepare a power spectrum;

(3) the power spectrum is then subjected to a frequency filtering treatment so as to be compensated to match well with human visual characteristics; and, (4) the compensated power spectrum is integrated, to determine the granularity of the image of the patch.

In this regard, the smaller granularity an image has, the less unevenness the image has.

The dot reproducibility of an image is evaluated by the following method.

(1) isolated dot images are printed out; and (2) the dot images are visually observed to determine whether the images have omissions (i.e., non-printed dot images).

Figure 2:
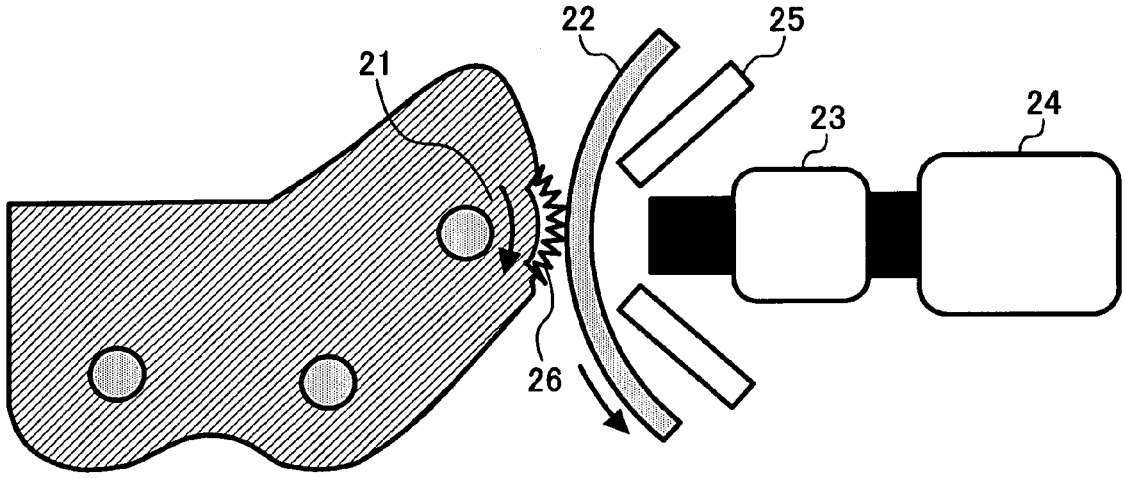
FIG. 2 is a schematic view illustrating an observation system for use in observing the behavior of a magnetic brush in a developing region.
Figure 3:
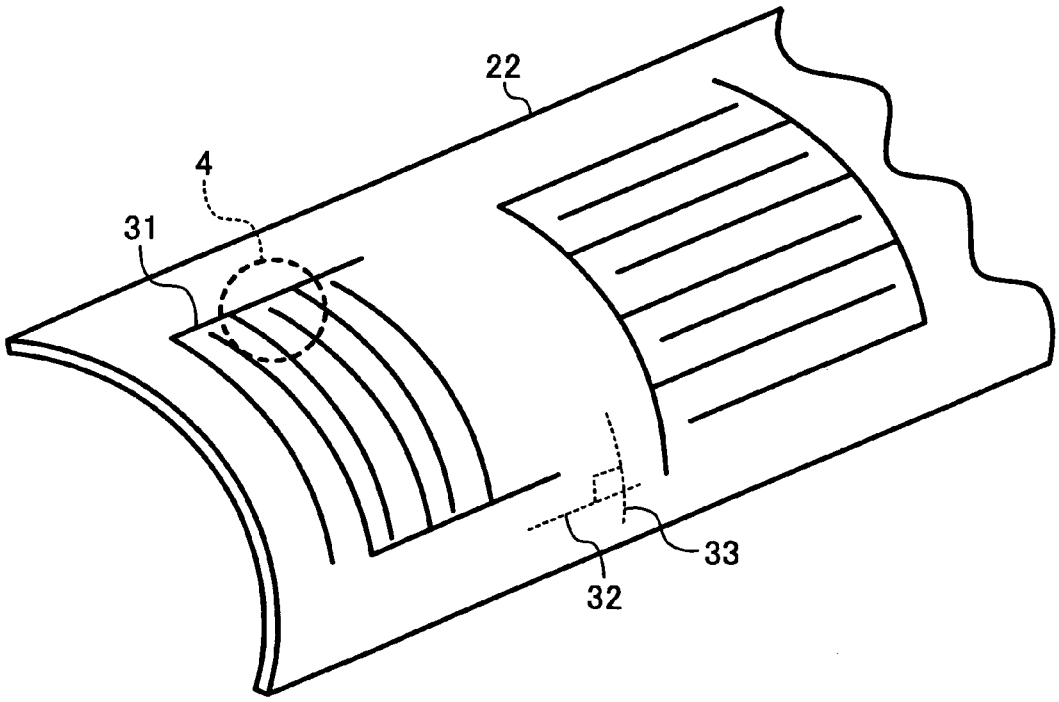
FIG. 3 is a schematic view illustrating the glass drum which is used in the observation system illustrated in FIG. 2 and serves as a substitute for an image bearing member.
Figure 4:
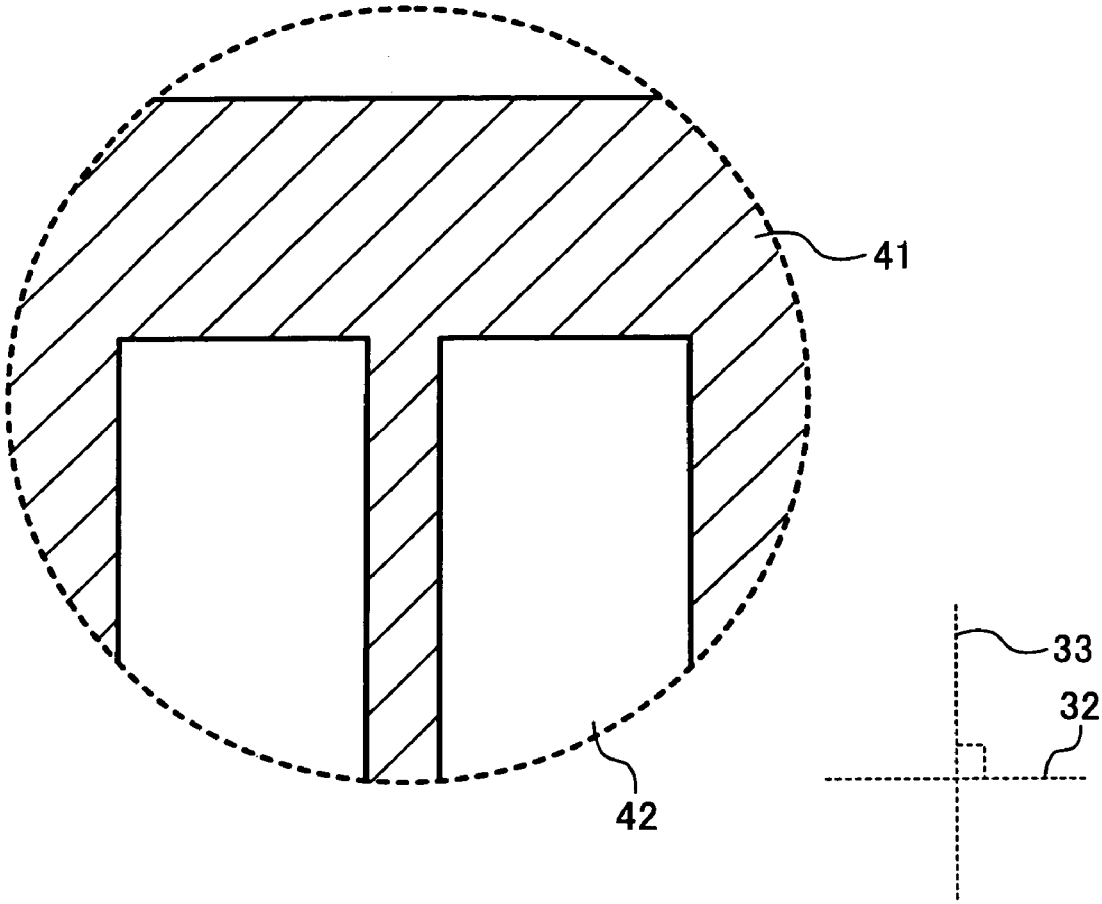
FIG. 4 is an enlarged view of a part of the glass drum illustrated in FIG. 3.

Then the area ratio of the carrier-noncontact portion will be explained. The ratio is determined using an observation system, which is illustrated in FIG. 2. FIG. 2 is a schematic view illustrating an observation system for use in observing the behavior of a magnetic brush in the developing region. Numeral 21 denotes a developing sleeve, which is used for real image forming apparatus such as copiers and printers. Numeral 22 denotes a transparent glass drum which corresponds to a photoreceptor in real image forming apparatus. Namely, the glass drum serves as a pseudo-photoreceptor and a portion of the glass drum is cut so that the cross section of the drum has an arch form. As illustrated in FIG. 3, the peripheral surface of the glass drum 22 has a transparent electrode 31 having a comb pattern, which is made of ITO (indium tin oxide). The electrode 31 has an image portion 41 which corresponds to an image portion of a photoreceptor and a non-image portion 42 as illustrated in FIG. 4. In addition, a charge transport layer is coated on the surface of the glass drum 22 by a method such as dip coating, kiss coating and spray coating.

A voltage is applied to the electrode 31 by a power source (not shown) such that the image portion 41 and the non-image portion have respective potentials, which correspond to the respective potentials of the image portion and non-image portion of a photoreceptor in a real image forming apparatus. In addition, a developing bias is applied to the developing sleeve 21. Therefore, the developing region under the same electric field conditions as those for a real image forming apparatus can be observed. In FIGS. 3 and 4, numeral 32 denotes a main scanning direction along which a laser beam for forming an electrostatic latent image is scanned in a real image forming apparatus. Numeral 33 denotes a sub-scanning direction.

The curvature of the glass drum 22 is the same as that of the photoreceptor to be simulated. Therefore, developing operations almost the same as real developing operations can be observed. In addition, the glass drum 22 can move at the same linear velocity as that of the photoreceptor to be simulated. In this observation system, as the diameter of the glass drum 22 increases, the angle of the arch of the glass drum 22 should be reduced in view of focus distance of the microscope used for observing the developing region. Furthermore, by using this observation system, the developing operation of the developer at a specific position of the developing sleeve 21 can be observed.

A stereomicroscope is preferably used as the microscope 23. This is because the stereomicroscope has a large focal depth and thereby the behavior of a toner particle can be observed while enlarged. Other microscopes such as metallurgical microscopes, super focus microscopes, and hard mirrors can also be used as the microscope 23.

A high speed camera 24 is used for observing the behavior of a toner and a developer under the same developing conditions (such as processing speed) as those for a real image forming apparatus to be simulated. The high speed camera 24 may be a monochrome camera or a color camera. Since a microscopic portion is observed by this system, there is a case where the light exposure is not enough to observe the portion. In such a case, an image intensifier (i.e., a photoelectron multiplier can be set between the microscope 23 and the high speed camera 24).

A light source 25 is a light guide used for illuminating the portion to be observed. At an end of the light source 25, a light emitting device (not shown) is provided. Suitable light emitting devices include halogen lamps, metal halide lamps and lasers. When the behavior of a toner is observed, there is a case where the toner is melt by the heat of the light source used. Therefore, it is preferable to use a light emitting device emitting cold light. In addition, when observation is made, light is preferably irradiated from the front side, but it is possible to irradiate light from the backside (in this case, the material to be observed is observed as shadow). Further, it is possible to irradiate sheet light having a width not greater than 100 μm in parallel to the plane to be observed, in order to avoid reflection light from materials other than the material to be observed, i.e., to clearly observe only the material to be observed.

As mentioned above, the observation system uses the glass drum 22 instead of a photoreceptor. The glass drum 22 has the uppermost layer which is the same as that of the photoreceptor to be simulated such that the glass drum has the same friction coefficient as that of the photoreceptor to be simulated. In addition, in order to electrostatically form an image portion and a non-image portion on the glass drum, transparent electrodes are formed on the surface of the glass drum 22, wherein voltages are applied to the electrodes so that the image and non-image portions have the same potential as those of the real image and non-image portions. The potential of the surface of the glass drum 22 can be controlled by controlling the voltages applied to the transparent electrodes.

The developing sleeve 21 is arranged so as to face the glass drum 22. It is preferable to use a quarter glass drum (i.e., an arch having an angle of 90°) for the glass drum 22 such that the tip of a magnetic brush 26 located at the developing region can be observed from the inside of the glass drum 22. When the observation is performed, the behavior of the toner and developer can be photographed using the stereomicroscope 23 and the high speed camera 24. The thus obtained images are then processed to separate carrier-noncontact portions (i.e., magnetic brush portions), to which the magnetic carrier is contacted, from carrier noncontact portions (i.e., air gap portions) with which the magnetic carrier is not contacted. In addition, information on the areas, average areas and numbers of the carrier-noncontact portions can be obtained.

Figure 5C:
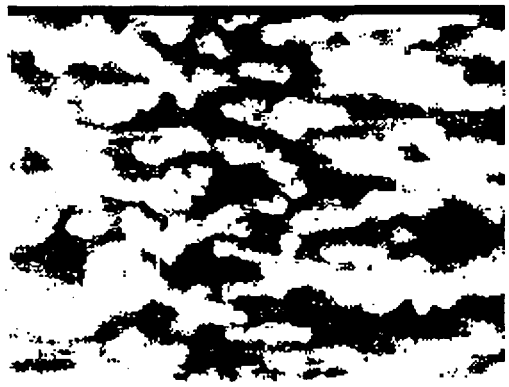
FIGS. 5A-5C are schematic views for explaining how the image of the developing region caught by the observation system is processed.
Figure 5B:
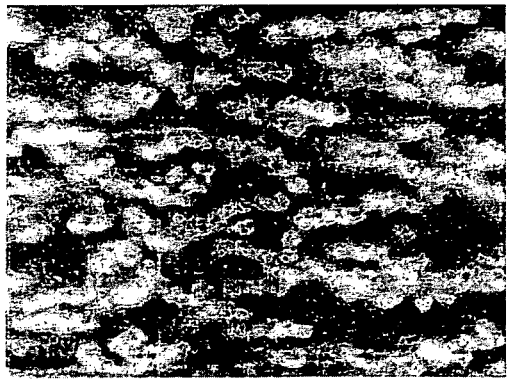
Figure 5A:
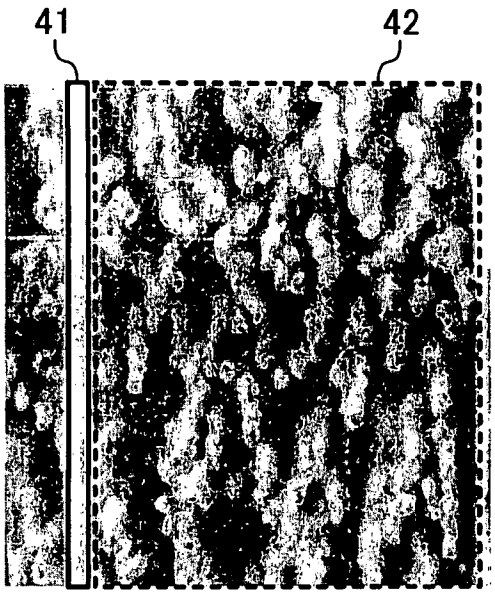

Then the image processing method will be explained. FIG. 5A illustrates a photograph of the developing region at a moment. At first, a non-image portion 42 of the glass drum 22 is extracted from the photograph. Numeral 41 denotes an image portion. The image of the extracted non-image portion 42 is illustrated in FIG. 5B. In FIG. 5B, the white portions and black portions represent the carrier-contact portion and the carrier-noncontact portion, respectively.

The photographing is performed under a condition of 15000 images/sec. The measurements of the areas of the carrier-contact and carrier-noncontact portions are performed at an interval of 9 images, and the total number of the images to be analyzed is 36. The measurements of the areas are performed using an image analyzing software, IMAGE HYPER II from DigiMo. In the measurements, the images are binarized while the threshold level of the black and white portions is properly set. In this case, the carrier-noncontact portions are illustrated as aggregates of pixels surrounded by the portions (i.e., white portions) with brightness 255 and the magnetic brush portions are illustrated as the portions with brightness 255 (i.e., white portions).

The areas of the carrier-noncontact portions, with which the magnetic carrier is not contacted, are determined by integrating areas Sij (i.e., area of the j-th portion of the i-th image) with respect to the 36 images. In this regard, whether or not images are connected is determined by a method using a 4-connected neighbor treatment, and portions having an area not greater than 20 pixels are not measured.

As the present inventor's study using the above-mentioned observation system, it is found that by properly setting the ratio, (Avc/vs), of the average moving velocity (vc) of carrier particles in the two component developer, which carrier particles are contacted with the image bearing member (i.e., photoreceptor) to the moving velocity (vs) of the surface of the developer bearing member, high quality images with good dot reproducibility and little granularity can be produced. As mentioned above, the carrier particles contacted with the photoreceptor include not only carrier particles contacted with the photoreceptor but also carrier particles being close to the photoreceptor.

In this case, the moving velocity of the magnetic carrier contacting the surface of the photoreceptor is not the same as that of the linear velocity of the surface of the developing sleeve. The reason is as follows. For example, when a developing sleeve having a radius (r) of 15 mm is rotated at a linear velocity (v) of 500 mm/sec and a cylindrical magnetic brush having a length (l) of 0.3 mm which extends in a direction perpendicular to the developing sleeve is contacted with the photoreceptor, the angular velocity (ω) of the developing sleeve is represented as follows:

$$\omega = v/r = 33.3 \text{ rad/sec.}$$

The linear velocity (v') of the magnetic carrier contacting the photoreceptor is represented as follows:

$$v' = (r+1)\omega = 510 \text{ mm/sec.}$$

Thus, the linear velocity (v') of the magnetic carrier is faster than the linear velocity of the developing sleeve. However, it is found by observation of the developing region that the magnetic brush does not have a cylindrical form, and in addition the tip portion of the magnetic brush makes a discontinuous movement due to the magnetic field applied and/or adjacent magnetic brushes. Specifically, as the distance between the tip portion of a magnetic brush and the magnets in the developing sleeve increases, the magnetic force that the tip portion receives decreases (i.e., the binding force of the magnets decreases). Therefore, the friction force generated between the surface of the photoreceptor and the carrier particles contacting the surface of the photoreceptor is greater than the force in the rotation direction of the developing sleeve that the carrier particles receive from the rotating developing sleeve due to the binding force of the magnets. Therefore, the linear velocity of the carrier particles contacting the surface of the photoreceptor is almost the same as that of the photoreceptor.

The movement of a predetermined magnetic carrier particle in a magnetic brush can be determined by analyzing photographs which are taken at an interval of $1/15000$ seconds by a PTV method using an image analyzing software, IMAGE TRACKER PTV included in IMAGE HYPER II mentioned above. By analyzing the movement of the particle, the track, moving velocity, acceleration and moving direction of the particle can be determined. For example, provided that the absolute value of the moving velocity of a magnetic carrier particle (i) for a time (t) is $v_{it}$, and (m) pieces of carrier particles having a moving velocity of $v_{it}$ are observed for a time of ($1/15000 \times n$) seconds, the average linear velocity Avc is represented by the following equation:

$$Avc = \frac{\sum_i \frac{\sum_n Vit}{n}}{m}$$

In the analyzing method used for the present invention, 20 pieces of carrier particles (i) are analyzed to determine the moving velocity $v_{it}$ for a time (t). Then, the average of all the data (n=753) is obtained. Thus, Avc can be determined.

In addition, the linear velocity (vs) of the developing sleeve can be controlled by controlling the revolution of the driving motor of the developing sleeve. The linear velocity of the developing sleeve can be determined by monitoring the velocity using a tachometer.

Then an example of the developing method of the present invention will be explained.

The developing method of the present invention is characterized in that the following relationships (1) and (2) are satisfied:

$$0.30 \leqq A_{nc}/A_t \leqq 0.70 \quad (1)$$

wherein $A_t$ represents the area of the development portion of the image bearing member, and $A_{nc}$ represents the area of a carrier-noncontact portion in the development portion, with which the magnetic carrier is not contacted when the development portion has no latent image, and $$0.8 \leqq Avc/vs \leqq 1.1 \quad (2)$$

wherein Avc represents the average moving velocity of carrier particles in the two component developer, which carrier particles are contacted with the image bearing member, and vs represents the moving velocity of the surface of the developer bearing member (i.e., the developing sleeve) used.

When the relationships (1) and (2) are satisfied, high quality images having a good combination of dot reproducibility and granularity can be produced. When the ratio ($A_{nc}/A_t$) is too small, the developer tends to stay in the surface of the photoreceptor (i.e., the magnetic brush is moved in a direction opposite to the rotation direction of the photoreceptor). Therefore, the resultant solid images have unevenness (i.e., granular images are formed). In addition, when an electrostatic latent image is developed with carrier particles, which are located on the tip of a magnetic brush and which develop the latent image while being separated from the magnetic brush and moving along the surface of the photoreceptor, the movement of the carrier particles is slow, and thereby high quality images cannot be produced.

In contrast, when the ratio ($A_{nc}/A_t$) is too large, the resultant images have poor dot reproducibility. In addition, the magnetic carrier is unevenly contacted with the surface of the photoreceptor, resulting in formation of granular images.

When the ratio Avc/vs is too small, the number of the carrier particles, which pass over a latent image to be developed while developing the latent image, decreases, and thereby the image density of a solid image is decreased. Since the frictional force between the surface of the photoreceptor and the toner or carrier is balanced with the binding force caused by the magnetic field generated by the magnets in the developing sleeve, the ratio Avc/vs is considered not to exceed 1.1.

As a result of the present inventor's study of distribution of the areas (S) of the carrier-noncontact portions in a non-image portion of the photoreceptor, with which magnetic carrier particles are not contacted, it is found that when the percentage of carrier-noncontact portions satisfying a relationship, $S \leqq \pi (Dw/2)^2$ (wherein Dw represents the weight average particle diameter of the magnetic carrier), is not less than 10% by number, high quality images with good dot reproducibility can be produced. When the percentage of the carrier-noncontact portions satisfying the relationship is too low, high quality images cannot be produced because toner particles enough to fill dot latent images are not present on the magnetic carrier.

In addition, the percentage of the carrier-noncontact portions satisfying a relationship, $S \leqq 5\pi (Dw/2)^2$, is not less than 30% by number, high quality images with little granularity (i.e., solid images with good fullness) can be produced.

Further, it is found that when the percentage of the carrier particles satisfying relationship (3), $vp \leqq vc \leqq 2vs$ (wherein vp represents the absolute value of the linear velocity of the photoreceptor) is not less than 90% by number or the percentage of the carrier particles satisfying relationship (4), $0.625 \leqq vc/vs \leqq 1.5$, is not less than 80% by number, high quality images with good dot reproducibility and little granularity (i.e., good fullness in solid images) can be produced.

Namely, when the moving velocity (vc) of the carrier particles contacting the image bearing member is lower than the absolute value of the linear velocity (vp) of the photoreceptor, i.e., when the developer tends to stay in the developing region, the carrier particles located in the vicinity of non-image portions receive counter charges or an induced electric field. In this case, problems which occur are that carrier particles are adhered to latent images and edge portions of latent images in the main scanning direction are developed so as to be narrower than those of the latent images.

The linear velocity (vp) of the photoreceptor can be controlled by controlling the revolution of a driving motor and can be measured using a tachometer.

In the developing method of the present invention, the developer layer, which is formed on the surface of the developing sleeve by a developer thickness controlling member, preferably has a weight of from 40 to 80 mg/cm$^2$ just after the thickness controlling operation. When the weight is too light, images with high image density cannot be produced. In this case, when the electric field applied to the developing sleeve and the photoreceptor is increased to increase the image density, another problem in that carrier particles are adhered to latent images occurs. In contrast, when the weight is too heavy, a problem in that carrier particles (i.e., developer) fall away from the developing sleeve on a downstream side from the developer thickness controlling member relative to the rotation direction of the developing sleeve occurs. In addition, since the developer layer has too high a filling factor, the developer has a poor fluidity. In this case, a sufficient amount of toner particles cannot be supplied to latent images, and thereby problems in that the resultant toner images have low image density or unevenness are often caused.

The weight of the developer layer on the developing sleeve can be determined by the following method:

(1) the developing sleeve is rotated under the real developing conditions;

(2) the developing sleeve is suddenly stopped;

(3) a cylinder made of a non-magnetic metal and having a cross section of 5 mm×20 mm and a round tip whose curvature is the same as that of the surface of the developing sleeve is set on the surface of the developing sleeve so as to be right above the main magnet 15 illustrated in FIG. 1, to surround a region of the developer layer;

(4) the developer layer in the region surrounded by the cylinder is collected using a magnet; and (5) the weight of the collected developer is measured, and the weight of the developer layer per a unit area ($cm^2$) is calculated.

In addition, the ratio (vs/vp) of the linear velocity of the linear velocity (vs) of the developing sleeve to the linear velocity (vp) of the photoreceptor is preferably from 1.5 to 2.5. When the ratio is within the range, high quality images can be produced. When the ratio is too small, the number of magnetic brushes contacting an electrostatic latent image decreases, and thereby the latent image is not fully developed, resulting in decrease of image density. In contrast, when the ratio is too large, the number of magnetic brushes contacting an electrostatic latent image increases, and thereby abnormal image problems such that end portions of solid images have a low image density; and the resultant images have omissions tend to be caused. In particular, problems in that end portions of half tone images have omissions; and the boundary portions between a solid image and a half tone image have image densities different from those of the other portions of the solid image and the half tone image, respectively, occur. Namely, abnormal images such as uneven images or omissions are formed at points in which the potentials of latent images are suddenly changed. The reason therefor is considered to be that when the developer passes an electrostatic latent image, the toner particles in the developer move, and/or the developer layer, which is a dielectric layer and has a capacitance, causes a transient phenomenon when the developing layer passes a point in which the electric field is discontinuously changed.

In the developing method of the present invention, it is preferable that the content of toner in the developer is preferably from 5.0 to 9.0% by weight and the average charge quantity of toner is from 15 to 60 μC/g in absolute value in order that the surface of magnetic carrier particles are properly covered with toner particles and the resultant developer has good fluidity. In this case, high quality images can be produced for a long period of time even when a small magnetic carrier and a small toner are used.

When the toner content is too low, the charge quantity of the resultant developer increases. Therefore, the developing bias has to be increased when an electrostatic latent image is developed, and thereby the life of the photoreceptor is shortened. When the absolute value of the charge quantity of the developer is too large, the resultant images have low image density. In contrast, when the toner content is too high, the charge quantity of the resultant developer decreases. Therefore, toner particles tend to scatter, resulting in occurrence of a background development problem in that images whose background areas are soiled with toner particles are formed. When the charge quantity of the developer is too small, the background development problem is also caused.

The toner content in a developer and the average charge quantity of a developer can be determined by a blow-off method. The measurement conditions are as follows.

Weight of developer used for measurement: 0.5±0.05 g

Blowing pressure: 0.22 to 0.24 MPa

Position of tip of nozzle: position with a distance of 2 mm from the upper surface of the gage Blowing time: 10 seconds The covering rate (CR) at which the toner particles cover the carrier particles is determined by the following equation:

$$CR(\%)=25\times(Wt/Wc)\times(\rho c/\rho t)\times(Dc/Dt)$$

wherein Wt and Wc represent the weights (gram) of the toner and carrier in the developer, respectively; ρt and ρc represent the true densities of the toner and carrier in the developer, respectively; and Dt and Dc represent the weight average particle diameters of the toner and carrier in the developer, respectively. The covering rate (CR) is preferably from 10 to 80%, and more preferably from 20 to 60%.

The weight average particle diameter (Dw) of a magnetic carrier can be determined on the basis of a particle diameter distribution on a number basis using the following equation:

$$Dw=\Sigma(nD^4)/(nD^3)$$

wherein D represents the particle diameter representing a particle diameter channel and has a unit of μm; and n is the total number of particles having a particle diameter in the particle diameter channel. The "channel" means a particle diameter range by which the particle diameter distribution curve is equally divided into several tens of segments. The particle diameter D of a channel means the lower limit particle diameter of the channel. In this application, the particle diameter distribution of a carrier is measured with an instrument, MICROTRACK PARTICLE DIAMETER ANALYZER MODEL HRA9320-X100 from Honeywell. The measurement conditions are as follows:

Particle diameter range: 8 to 100 μm

Channel width: 2 μm

Number of channels: 46

The toner for use in the developing method of the present invention preferably has a weight average particle diameter of from 4.5 to 8.0 μm, and the ratio (Dw/Dn) of the weight average particle diameter (Dw) of the toner to the number average particle diameter (Dn) thereof is preferably from 1.00 to 1.20. In this case, images having high image density and high resolution can be stably produced.

In order to produce high resolution images, it is preferable to use a toner having a small particle diameter. However, when the weight average particle diameter is too small, the resultant developer has poor fluidity, and thereby it is hard to control the toner concentration to be uniform in the entire developer. In addition, the surface of the magnetic carrier is covered by the toner at a high covering rate, and thereby problems in that the magnetic carrier is contaminated by the toner and toner particles scatter are caused. In this case, by controlling the ratio (Dw/Dn) to be from 1.00 to 1.20, the fluidity of the developer can be improved, and the toner concentration in the developer can be uniformized.

In addition, it is preferable that toner particles having a particle diameter not greater than 3 μm are included in the toner in an amount of not greater than 5% by weight. In this case, the toner has a good combination of fluidity and preservability, and thereby the toner can be well supplied to a developing device and the toner is quickly charged in the developing device (i.e., the charge rising property of the toner can be improved).

In the present application, the particle diameter distribution of a toner can be determined by a method using a small hole passing method (i.e., a method using a COULTER COUNTER). Specifically, an instrument, COULTER COUNTER MODEL TA II from Beckman Coulter Inc., is used while an interface by which the number-basis particle diameter distribution and weight-basis particle diameter distribution can be output is connected therewith, and an aperture (i.e., a small hole) having a diameter of 100 μm is used. The measuring method is as follows.

(1) at first a sample (toner) is dispersed in an electrolyte solution including a surfactant to prepare a dispersion of the sample;

(2) a 1% solution of NaCl is added to the dispersion;

(3) a voltage is applied to two electrodes, which are set on the both sides of the aperture, through the electrolyte solution to measure a current, i.e., to determine changes of resistance; and (4) the particle diameters (from 2 to 40 μm) of the particles of the sample are determined from the changes of the resistance, resulting in determination of the number average particle diameter and the weight average particle diameter.

The magnetic carrier for use in the developing method of the present invention includes a magnetic core material and a non-magnetic resin layer covering the surface of the core material. The core material preferably has a weight average particle diameter of from 25 to 45 μm. When the weight average particle diameter is too large, the carrier can be borne on the surface of the developing sleeve by a large magnetic force and thereby a carrier adhesion problem in that carrier particles are adhered to electrostatic latent images is hardly caused. However, the surface area of carrier particles per unit weight decreases, and thereby the image density of the resultant toner images is decreased. In this case, when the toner concentration is increased to increase the image density, the background development problem in that the background areas of images are soiled with toner particles is caused. In addition, when fine dot images are developed, a problem in that the diameters of the resultant toner images vary tends to occur. In contrast, when the weight average particle diameter of the magnetic carrier is too small, magnetic moment of one magnetic carrier particle decreases, and thereby the carrier particles are borne on the surface of the developing sleeve by a small magnetic force, resulting occurrence of the above-mentioned carrier adhesion problem.

It is preferable for the magnetic carrier to have a weight average particle diameter of from 25 to 45 μm. In addition, the magnetic carrier preferably includes particles having a particle diameter less than 44 μm in an amount of not less than 70% by weight; particles having a particle diameter greater than 62 μm in an amount of less than 1% by weight; and particles having a particle diameter less than 22 μm in an amount of not greater than 7.0% by weight. A magnetic carrier having such a relatively small particle diameter has an advantage over a magnetic carrier having a relatively large particle diameter such that the area of a carrier-noncontact portion at the tip of the magnetic brush is decreased. In addition, such a small magnetic carrier also has an advantage such that even when the area of the carrier-noncontact portion is the same, the number of carrier particles contacting the surface of a photoreceptor is larger than that of carrier particles in a case where a large magnetic carrier is used, and thereby an electrostatic latent image can be uniformly developed, resulting in formation of a toner image with little granularity.

In addition, it is preferable that the magnetic carrier includes particles having a particle diameter not less than 62 μm in an amount of less than 3% by weight, and more preferably less than 1% by weight. When the amount is too large, variation of the diameter of the resultant dot toner images increases, i.e., the resultant toner images have poor dot reproducibility.

Further, it is preferable for the magnetic carrier to include particles having a particle diameter less than 22 μm in an amount of not greater than 7% by weight, more preferably not greater than 3% by weight, and even more preferably not greater than 1% by weight. When the amount is too large, the carrier adhesion problem tends to occur.

It is preferable that the magnetic carrier has a magnetization of from 70 to 100 $A \cdot m^2/kg$, and more preferably from 76 to 100 $A \cdot m^2/kg$, at a magnetic field of $1 \times 10^6/4\pi$ [A/m]. When the magnetization is too small, the carrier adhesion problem tends to occur.

The method for measuring the magnetization is as follows.

(1) one (1.0) gram of a sample is set in a cylindrical cell of a B-H TRACER BHU-60 from Riken Denshi Co., Ltd.;

(2) a magnetic field is applied thereto while gradually changing from 0 to $3 \times 10^6/4\pi$ [A/m];

(3) then the magnetic field is gradually decreased from $3 \times 10^6/4\pi$ to 0 [A/m];

(4) further the opposite magnetic field is applied thereto while gradually changing the magnetic field from 0 to $3 \times 10^6/4\pi$ [A/m];

(5) then the magnetic field is gradually decreased from $3 \times 10^6/4\pi$ to 0 [A/m]; and (6) furthermore the first-mentioned magnetic field is again applied thereto to prepare a B-H curve of the sample and to determine the magnetization of the sample at $1 \times 10^6/4\pi 0$ [A/m].

Specific examples of the materials having a magnetization not less than 76 $A \cdot m^2/kg$ include ferromagnetic materials such as iron, and cobalt; magnetite, hematite, Li-containing ferrite, Mn—Zn ferrite, Cu—Zn ferrite, Ni—Zn ferrite, Ba-containing ferrite, Mn—Mg—Sr ferrite, and Mn-containing ferrite.

Ferrites are sintered materials having the following formula:

$$(MO)x(NO)y(Fe_2O_3)z$$

wherein x, y and z represent composition ratios (i.e., numbers of from 0 to 1); each of M and N represents an element such as Ni, Cu, Zn, $Li_2$, Mg, Mn, Sr and Ca. Thus, ferrites are perfect mixtures of a metal oxide and an oxide of iron (III).

Known resins can be used for the non-magnetic resin layer. For example, silicone resins including a repeat unit having at least one of the following formulae are preferably used:

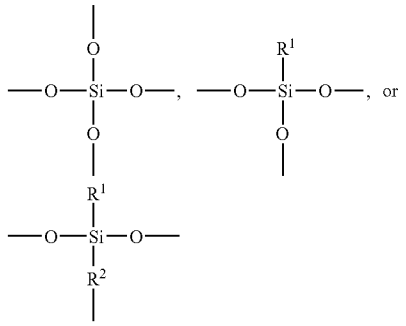

wherein $R^1$ represents a hydrogen atom, a halogen atom, a hydroxyl group, an alkyl group having 1 to 4 carbon atoms or an aryl group such as phenyl and tolyl groups; and $R^2$ represents an alkylene group having 1 to 4 carbon atoms or an arylene group such as a phenylene group.

Specific examples of the marketed silicone resins for use in the resin layer include KR-271, KR-272, KR-282, KR-252, KR-255 and KR-152, which are manufactured by Shin-Etsu Chemical Co., Ltd.; SR2400 and SR2406, which are manufactured by Dow Corning Toray Silicone Co., Ltd.; etc. In addition, modified silicone resins such as epoxy-modified silicone resins, acrylic-modified silicone resins, phenol-modified silicone resins, urethane-modified silicone resins, polyester-modified silicone resins, and alkyd-modified silicone resins can also be used therefor. Specific examples of the marketed modified silicone resins include ES-1001N (epoxy-modified silicone resin), KR-5208 (acrylic-modified silicone resin), KR-5203 (polyester-modified silicone resin), KR-206 (alkyd-modified silicone resin), and KR-305 (urethane-modified silicone resin), which are manufactured by Shin-Etsu Chemical Co., Ltd.; SR2115 (epoxy-modified silicone resin) and SR2110 (alkyd-modified silicone resin), which are manufactured by Dow Corning Toray Silicone Co., Ltd.; etc.

The resin layer preferably includes an aminosilane coupling agent in an amount of from 0.001 to 30% by weight based on the weight of the resin (such as silicone resins). Specific examples thereof include the following compounds.

$H_2N(CH_2)_3Si(OCH_3)_3$, $H_2N(CH_2)_3Si(OC_2H_5)_3$, $H_2N(CH_2)_3Si(CH_3)_2(OC_2H_5)$, $H_2N(CH_2)_3Si(CH_3)(OC_2H_5)_2$, $H_2NCH_2CH_2NHCH_2Si(OCH_3)_3$, $H_2NCH_2CH_2NHCH_2CH_2CH_2Si(CH_3)(OCH_3)_2$, $H_2NCH_2CH_2NHCH_2CH_2CH_2Si(OCH_3)_3$, $(CH_3)_2N(CH_2)_3Si(CH_3)(OC_2H_5)_2$, and $(C_4H_9)_2N(CH_2)_3Si(OCH_3)_3$.

Other resins can be used for the resin layer in combination with a silicone resin. Specific examples of such resins include homopolymers and copolymers of styrene and its derivatives such as polystyrene resins, polychlorostyrene resins, poly-α-methyl styrene resins, styrene-chlorostyrene copolymers, styrene-propylene copolymers, styrene-butadiene copolymers, styrene-vinyl chloride copolymers, styrene-vinyl acetate copolymers, styrene-maleic acid copolymers, styrene-acrylate copolymers (e.g., styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (e.g., styrene-methyl methacrylate copolymers, styrene-ethyl methacrylate copolymers, styrene-butyl methacrylate copolymers, and styrene-phenyl methacrylate copolymers), styrene-methyl α-chloroacrylate copolymers, and styrene-acrylonitrile-acrylate copolymers; epoxy resins, polyester resins, polyethylene resins, polypropylene resins, ionomer resins, polyurethane resins, ketone resins, ethylene-ethyl acrylate resins, xylene resins, polyamide resins, phenolic resins, polycarbonate resins, melamine resins, etc.

Specific examples of the method for forming a resin layer on a core material of the magnetic carrier include known coating methods such as spray drying methods, dip coating methods, powder coating methods and methods using a fluidized bed type coating machine. Among these methods, the methods using a fluidized bed type coating machine are preferably used because a uniform resin film can be formed on a core material.

The resin layer formed on a core material preferably has a thickness of from 0.02 to 1 μm, and more preferably from 0.03 to 0.8 μm. Since the resin layer is very thin, the particle diameter distribution of the coated magnetic carrier is substantially the same as that of the core material.

The volume resistivity of the magnetic carrier is adjusted if desired. The volume resistivity of the magnetic carrier can be adjusted by changing the resistivity and/or the thickness of the resin to be coated on the core material. It is possible to add a particulate electroconductive material in the resin layer to adjust the resistivity of the magnetic carrier. Specific examples of the electroconductive materials for use in the resin layer include metal powders such as aluminum powders, metal oxides such as electroconductive zinc oxide, and $SnO_2$ which is optionally doped with an element (such as antimony), borates such as $TiB_2$, $ZnB_2$, and $MoB_2$, silicon carbide, electroconductive polymers such as polyacetylene, polyparaphenylene, poly(p-phenylenesulfide), polypyrrole and polyethylene, carbon blacks such as furnace blacks, acetylene blacks, and channel blacks, etc.

Such electroconductive powders can be included in the resin layer, for example, by the following method:

(1) an electroconductive powder is mixed with a solution of a resin to be coated on the magnetic carrier; and (2) the mixture is then subjected to a dispersion treatment using a mill such as ball mills and bead mills or an agitator having a high speed rotor such as HOMOMIXERS.

The toner for use in the developing method of the present invention preferably includes at least a binder resin, a colorant and a charge controlling agent. Toners having irregular forms or spherical forms, which are prepared by a polymerization method or a granulating method, can be used as the toner. In addition, both a magnetic toner and a non-magnetic toner can be used as the toner.

Any known resins for use as binder resins of conventional toners can be used as the binder resin of the toner. Specific examples of the binder resin include homopolymers of styrene and substituted styrene such as polystyrene, poly-p-chlorostyrene and polyvinyltoluene; styrene copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers and styrene-maleic acid ester copolymers; and other resins such as polymethyl methacrylate, polybutyl methacrylate, polyvinyl chloride, polyvinyl acetate, polyethylene, polypropylene, polyesters, polyvinyl butyral resins, acrylic resins, rosin, modified rosins, terpene resins, phenolic resins, aliphatic or alicyclic hydrocarbon resins, aromatic petroleum resins, chlorinated paraffin, paraffin waxes, etc. These resins are used alone or in combination.

Suitable materials for use as the colorant includes dyes and pigments which can produce color toner images such as yellow, magenta, cyan and black color images. Any known dyes and pigments used for conventional color toners can be used as the colorant of the toner. Specific examples of such dyes and pigments include Nigrosine dyes, Aniline Blue, chalcooil blue, DUPON OIL RED, Quinoline Yellow, methylene blue chloride, Phthalocyanine Blue, Phthalocyanine Green, HANSA YELLOW G, Rhodamine 6C Lake, chrome yellow, quinacridone, BENZIDINE YELLOW, Malachite Green, Malachite Green hexalate, Rose Bengale, monoazo dyes and pigments, disazo dyes and pigments, trisazo dyes and pigments, etc. The content of the colorant in the toner is preferably from 1 to 30% by weight, and more preferably from 3 to 20% by weight.

Both positive or negative charge controlling agents can be used as the charge controlling agent. In a case of color toner, white charge controlling agents are preferably used in order that the color of the toner is not changed by the charge controlling agent used.

Suitable positive charge controlling agents include quaternary ammonium salts, imidazole metal complexes, imidazole salts, etc. Suitable negative charge controlling agents include salicylic acid complexes, salicylic acid salts, organic borates, calixarene compounds, etc.

A release agent can be included in the toner for use in the developing method of the present invention to improve the releasability of the toner. Specific examples thereof include synthetic waxes such as low molecular weight polyethylene, and low molecular weight polypropylene; vegetable waxes such as candelilla waxes, carnauba waxes, rice waxes, Japan waxes, and jojoba oils; animal waxes such as bees waxes, lanolin, and whale waxes; mineral waxes such as montan waxes and ozocerite; oil- or fat-based waxes such as hardened caster oil, hydroxystearic acid, fatty acid amides, and phenol-carboxylic acids; etc. These release agents can be used alone or in combination.

Additives such as plasticizers (e.g., dibutyl phthalate and dioctyl phthalate) and resistivity controlling magnets (e.g., tin oxide, lead oxide and antimony oxide) can also be included in the toner to adjust the thermal properties, electric properties and physical properties of the toner.

In addition, a fluidity controlling agent can be included in the toner. Specific examples of such a fluidity controlling include powders of silica, titanium oxide, aluminum oxide, magnesium fluoride, silicon carbide, boron carbide, titanium carbide, zirconium carbide, boron nitride, titanium nitride, zirconium nitride, magnetite, molybdenum disulfide, aluminum stearate, magnesium stearate, zinc stearate, fluorine-containing resins, acrylic resins, etc. These materials can be used alone or in combination. It is preferable to use a fluidity controlling agent which has a primary particle diameter not greater than 0.1 μm and the surface of which is subjected to a hydrophobizing treatment using an agent such as silane coupling agents and silicone oils such that the fluidity controlling agent has a hydrophobizing degree not less than 40.

The toner for use in the developing method of the present invention can be prepared by any one of known methods. For example, the following method can be used.

(1) toner constituents such as binder resins, colorants, pigments and charge controlling agents, and optional additives such as release agents are mixed in a proper mixing ratio using a mixer such as HENSCHEL MIXER, and ball mills;
(2) the mixture is then heated and kneaded using a kneader such as continuous extrusion kneaders having a screw, two roll mills, three roll mills, pressurized heating kneaders (when a color toner is prepared, a master batch pigment which is prepared by previously kneading the colorant and a part of the binder resin is typically used to improve the dispersion of the colorant in the kneaded mixture);
(3) after being cooled to be solidified, the kneaded mixture is crushed using a crusher such as hammer mills;
(4) the crushed mixture is pulverized using a pulverizer such as jet mills;
(5) then the pulverized mixture is treated by a pulverizer, such as impact pulverizers, jet pulverizers, and rotor pulverizers, which is connected with an air classifier, to prepare toner particles;
(6) a fluidity controlling agent is optionally added to the toner particles using a mixer such as HENSCHEL MIXER, super mixers and ball mills.

Specific examples of the impact pulverizers include hammer mills, ball mills, tube mills and vibration mills. Suitable pulverizers for use as the jet pulverizers in which crushed mixture is struck to an impact plate using compressed air include I TYPE or IDS TYPE IMPACT PULVERIZER (manufactured by Nippon Pnuematic Mfg. Co., Ltd.). Specific examples of the rotor pulverizers include roll mills, pin mills, fluidized bed type jet mills, etc. In particular, rotor pulverizers which include a fixed vessel serving as an outer wall, and a rotor coaxially provided in the vessel, such as TURBO MILL (from Turbo Kogyo Co., Ltd.), KRYPTON (from Kawasaki Heavy Industries, Ltd.), FINE MILL (from Nippon Pnuematic Mfg. Co., Ltd.), etc. Specific examples of the air classifier include dispersion separator type classifiers (from Nippon Pnuematic Mfg. Co., Ltd.), multi-fraction type classifiers ELBOW JET (from Nittetsu Mining Co., Ltd.), etc. In addition, by using a combination of an air classifier and a mechanical classifier, toner particles having a small average particle diameter can be obtained.

The main magnet pole which is located inside the developing sleeve and faces the developing region preferably has a magnetic flux density of from 60 mT to 120 mT (in air) in the normal line direction at the surface of the magnetic pole. When the magnetic flux density is in this range, high quality images with little granularity can be produced even when a direct electric field is applied as a developing bias. When the magnetic flux density is too large, the area of the carrier-noncontact portion with which the magnetic carrier is not contacted increases, and thereby granular images tend to be produced. In contrast, when the magnetic flux density is too small, the carrier adhesion problem tends to occur because the magnetic carrier is weakly bounded to the developing sleeve. The magnetic flux density can be measured with a three-dimensional magnetism measuring instrument (from Excel System Product Co., Ltd.). The measurement method is as follows.

(1) the probe 11TS-0A (from ADS Co., Ltd.) is set on a surface of the developing sleeve so as to face the main magnetic pole; and
(2) the magnetic flux density is measured using a gauss meter HGM-8905 (from ADS Co., Ltd.) while the magnet is rotated and the developing sleeve is not rotated.

The angle (hereinafter referred to as the main pole angle) formed by the normal line at the surface of the main magnetic pole and the common normal line of the developing sleeve and the photoreceptor is from 3° to 7° in the direction opposite to the rotation direction of the developing sleeve. When the main pole angle is too high in the direction, the developer tends to stay at the developing region and thereby high quality images can be produced. In contrast, when the main pole angle is low, a space is formed between the magnetic brush and the photoreceptor when the magnetic brush falls, and thereby granular images are produced.

Then an image forming apparatus (a tandem color laser printer) to which the above-mentioned example of the developing method of the present invention is applied will be explained referring to drawings.

Figure 6:
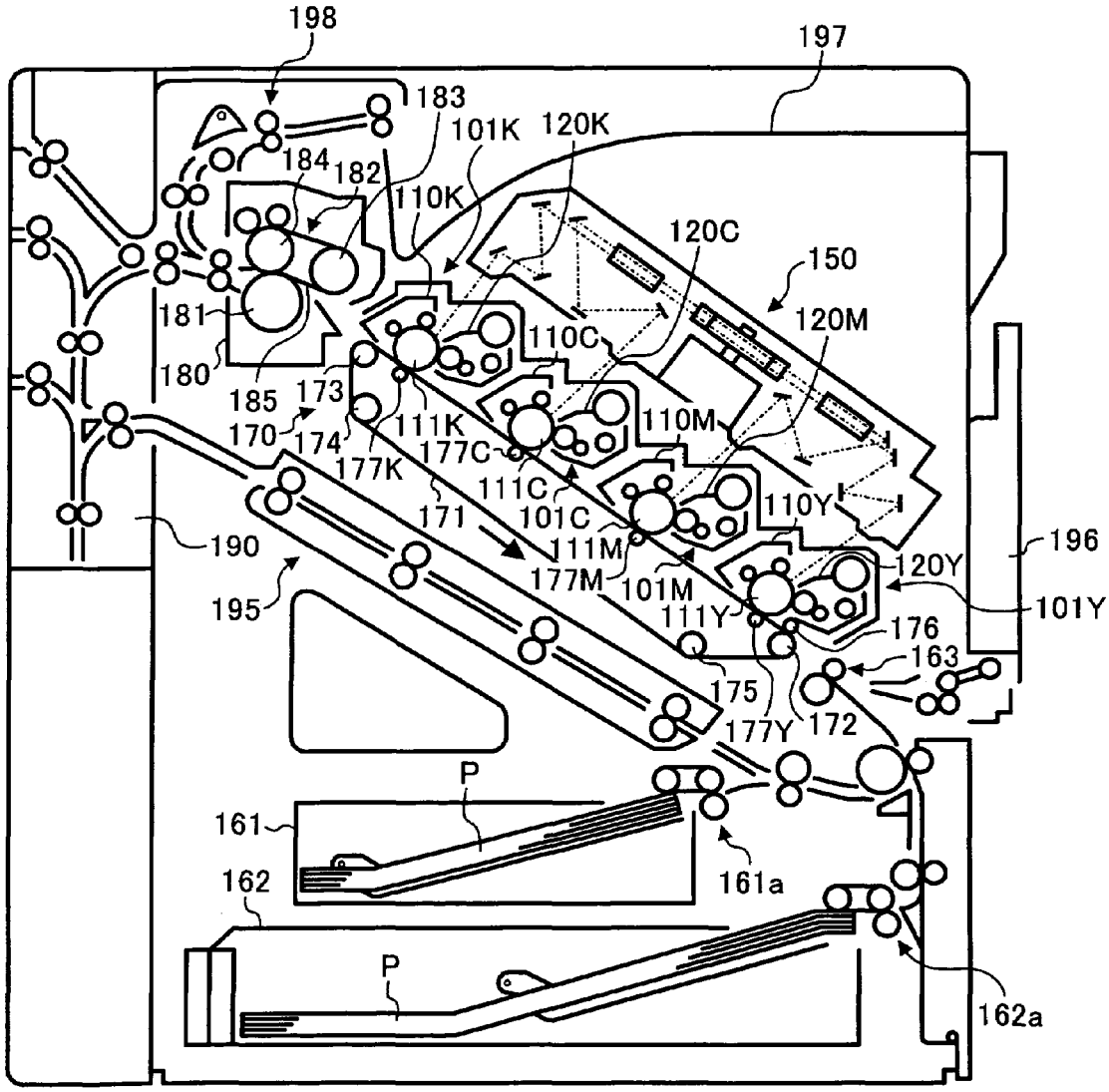
FIG. 6 is a schematic view illustrating an example of the image forming apparatus of the present invention.

FIG. 6 is a schematic view illustrating the tandem color laser printer (hereinafter referred to as the printer). The printer includes four image forming sections 101 (101Y, 101M, 101C and 101K), which produce yellow images, magenta images, cyan images and black images, respectively. In this regard, characters Y, M, C and K represent yellow, magenta, cyan and black colors, respectively.

The image forming sections 101 include process units 110 (110Y, 110M, 110C and 110K), and developing devices 120 (120Y, 120M, 120C and 120K). The process units 110 includes photoreceptors 111 (111Y, 111M, 111C and 111K) which serve as image bearing members.

The printer includes not only the image forming sections but also a light image writing unit 150, paper cassettes 161 and 162, a pair of registration rollers 163, a transfer unit 170, a fixing unit 180, a reverse feeding unit 190, paper re-feeding unit 195 and a manual feeding tray 196. In addition, the printer includes a toner container, a waste toner container and a power unit, which are not shown in FIG. 6.

The light image writing unit 150 includes a light source, a polygon mirror, an f-θ lens, a reflection mirror, etc., and scans the surfaces of the photoreceptors 111 with laser beams according to image data to form latent images corresponding to yellow, magenta, cyan and black color images on the respective photoreceptors.

Figure 7:
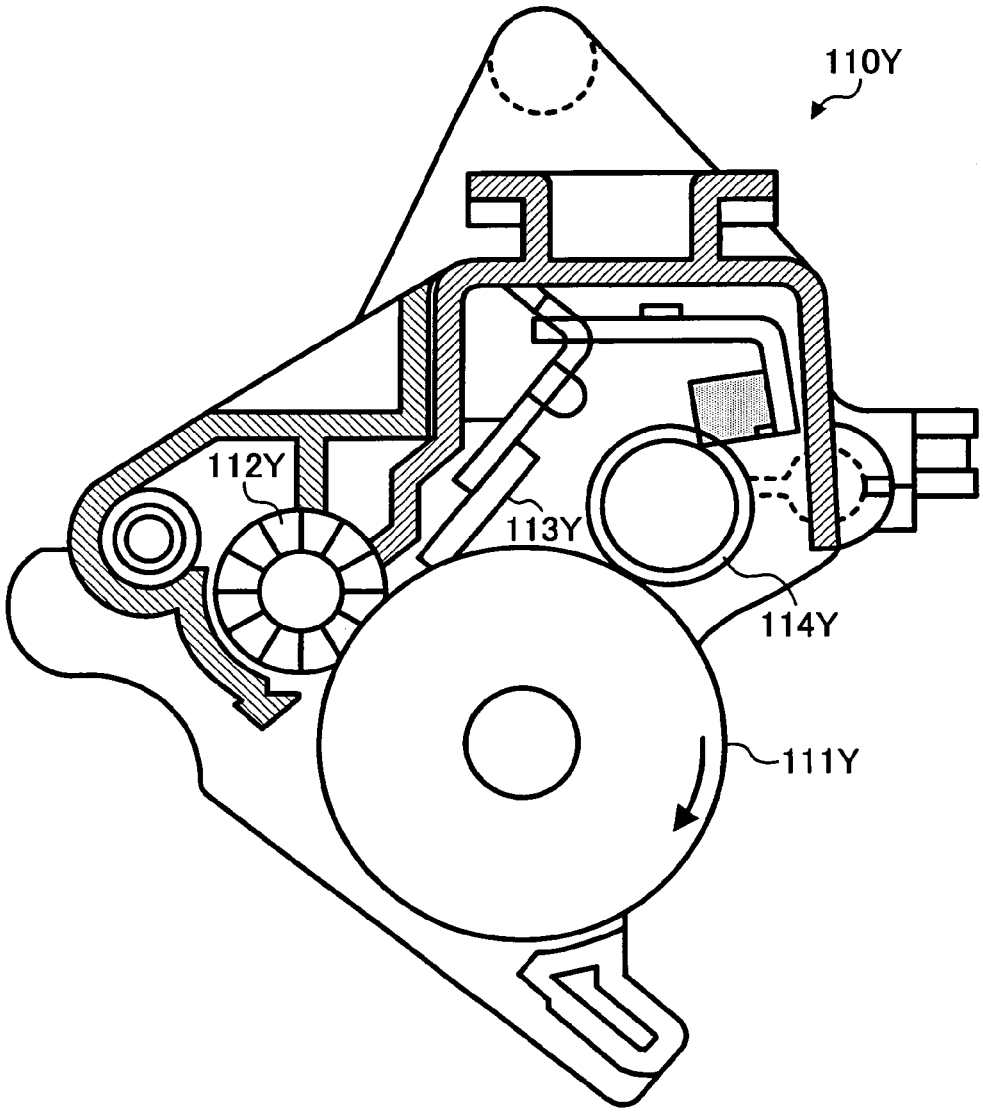
FIG. 7 is a schematic view illustrating a process unit for use in the image forming apparatus illustrated in FIG. 6.

FIG. 7 illustrates one (i.e., a process unit 110Y for yellow color) of the process units 110. Since the other process units have the same configuration, only the yellow process unit 110Y will be explained here. The yellow process unit 110Y includes the photoreceptor 111Y which is rotated counter-clockwise, a cleaning brush 112Y which is contacted with the surface of the photoreceptor to scrape toner particles remaining on the surface of the photoreceptor 111Y even after the image transfer process, a counter blade 113Y which is contacted with the surface of the photoreceptor to scrape toner particles remaining on the surface of the photoreceptor 111Y, a charging roller 114Y configured to uniformly charge the surface of the photoreceptor 111Y, etc. In addition, the yellow process unit 110Y includes a discharge lamp (not shown) configured to discharge the charges remaining on the surface of the photoreceptor even after the image transfer process.

The charging roller 114Y is contacted with or located closely to the photoreceptor with a small gap therebetween. An AC voltage is applied to the charging roller 114Y by a power source (not shown). The charging roller 114Y is rotated so as to counter the photoreceptor 111Y (i.e., the charging roller and the photoreceptor rotate clockwise in FIG. 7). Thus, the charging roller 114Y uniformly charges the surface of the photoreceptor 111Y.

Then the light image writing unit 150 imagewise irradiates the thus charged photoreceptor with a laser beam to form an electrostatic latent image for yellow color on the surface of the photoreceptor.

Figure 8:
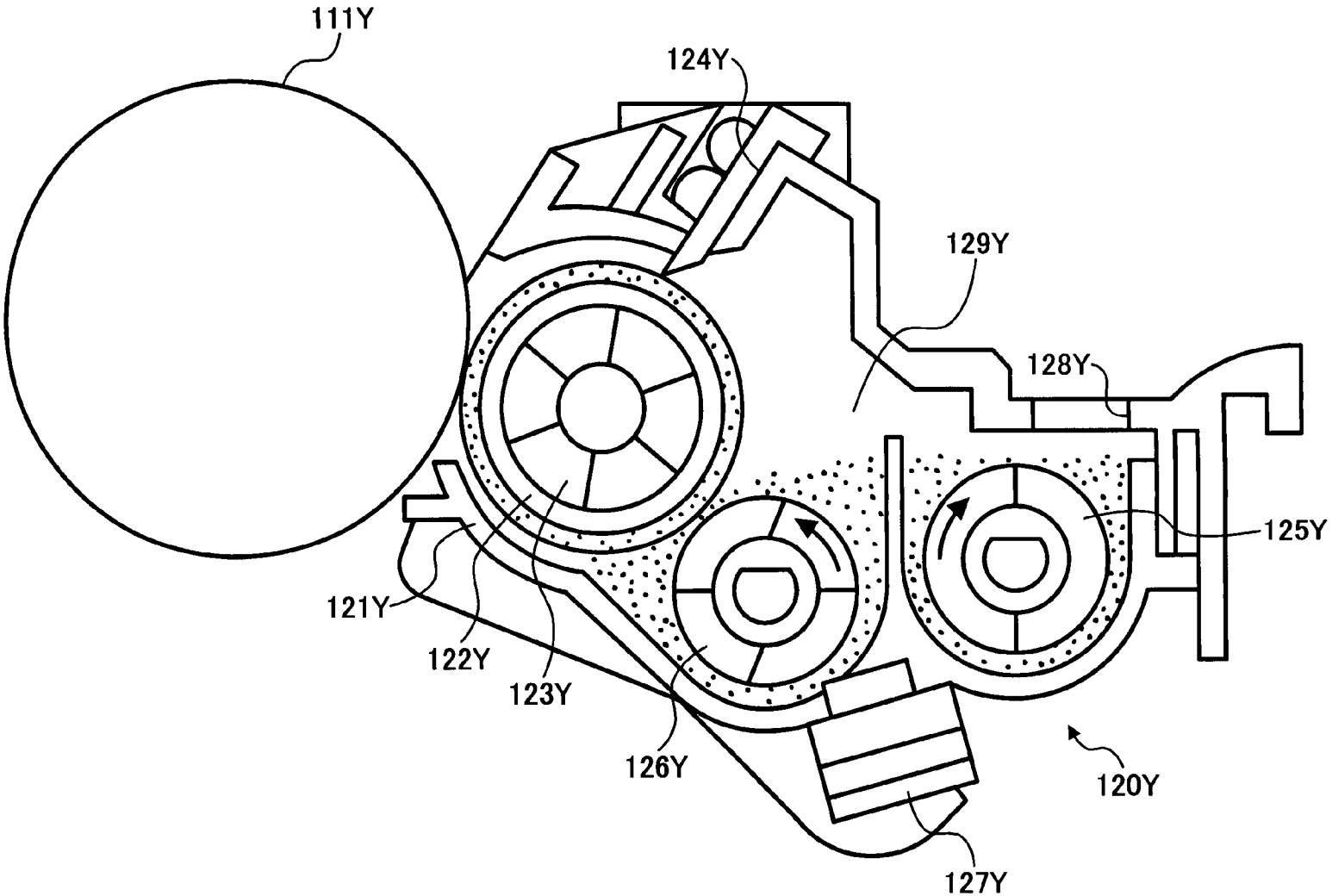
FIG. 8 is a schematic view illustrating an example of the developing device of the present invention for use in the image forming apparatus illustrated in FIG. 6.

FIG. 8 illustrates one (i.e., a developing devices 120Y for yellow color) of developing devices 120 and the photoreceptor 111Y. Since the other developing devices have the same configuration, only the yellow developing device 120Y will be explained. The yellow developing device 120Y includes a developing sleeve 122Y which is made of a non-magnetic pipe and which is rotated while exposing a portion thereof to the outside from an opening of a case 121Y of the developing device, a magnet roller 123Y which is not rotated and which serves as a magnetic force generator. In addition, the developing device 120Y includes a doctor blade 124Y, a fist feeding screw 125Y, a second feeding screw 126Y, a toner concentration sensor 127Y (hereinafter referred to as a T-sensor), a toner replenishing opening 128Y, etc.

The case 121Y forms a developer containing portion 129Y configured to contain a developer including a magnetic carrier and a non-magnetic yellow color toner having a negative charge. The developer is fed from a developer containing portion 129Y toward the developing sleeve 122Y while agitated and by the first feeding screw 125Y and the second feeding screw 126Y. The thus fed developer is drawn by the magnetic force of the magnetic poles in the developing sleeve 122Y, resulting in formation of magnetic brushes on the surface of the developing sleeve. The thickness of the magnetic brushes is controlled by the doctor blade 124Y. The thus formed developer layer is fed to the developing region in which the developing sleeve 122Y faces the photoreceptor 111Y with a gap (development gap) therebetween. The developing region means a point in which the surface of the developing sleeve 122Y comes close to the surface of the photoreceptor 111Y with the development gap therebetween and the vicinity of the point. In the developing region, the tip of the magnetic brush on the developing sleeve 122Y is contacted with the surface of the photoreceptor 111Y while moving, and thereby the yellow toner particles included in the magnetic brush are transferred to the electrostatic latent image on the photoreceptor, resulting in formation of a yellow toner image on the photoreceptor. Since the developing sleeve 122Y rotates, the magnetic brush from which the yellow toner particles are adhered to the latent image is returned to the developer container 129Y. On the other hand, the yellow toner particles adhered to the latent image (i.e., the yellow toner image) are fed while borne on the surface of the photoreceptor 111Y, and are transferred to a receiving material which is transported by a transfer belt mentioned below.

The T sensor 127Y includes a magnetic permeability sensor, and is set on a bottom plate of the case 121Y of the developing device. The T sensor outputs a voltage corresponding to the magnetic permeability of the developer fed by the second feeding screw 126Y. Since there is a strong correlation between the magnetic permeability of a developer and the concentration of toner included in the developer, the T sensor outputs a voltage depending on the toner concentration of the developer. The information of the voltage (i.e., the toner concentration) is sent to a controller (not shown). The controller includes a memory such as RAMs, which stores target values (Vtref) of the output voltages for yellow, magenta, cyan and black color developers. The controller compares the actual voltage output by the T sensor with the target value (Vtref) for the yellow color developer, and drives a powder pump for the yellow toner (not shown) to operate for a certain time, which is determined based on the comparison data.

Mohno pumps are typically used as the powder pump. The powder pump feeds the yellow toner contained in the Y toner container (not shown) to the developing device 120Y through the toner replenishing opening 128Y. As mentioned above, the powder pump is operated for a certain time determined based on the comparison data and therefore the yellow toner is supplied to the developing device 120Y in an amount corresponding to the amount of the yellow toner consumed. Thus, the concentration of the yellow toner in the yellow developer can be controlled in a predetermined range. Similarly to the yellow toner, magenta, cyan and black toners are supplied to the respective developing devices 120M, 120C and 120K by activating powder pumps for magenta, cyan and black colors (not shown).

Figure 9:
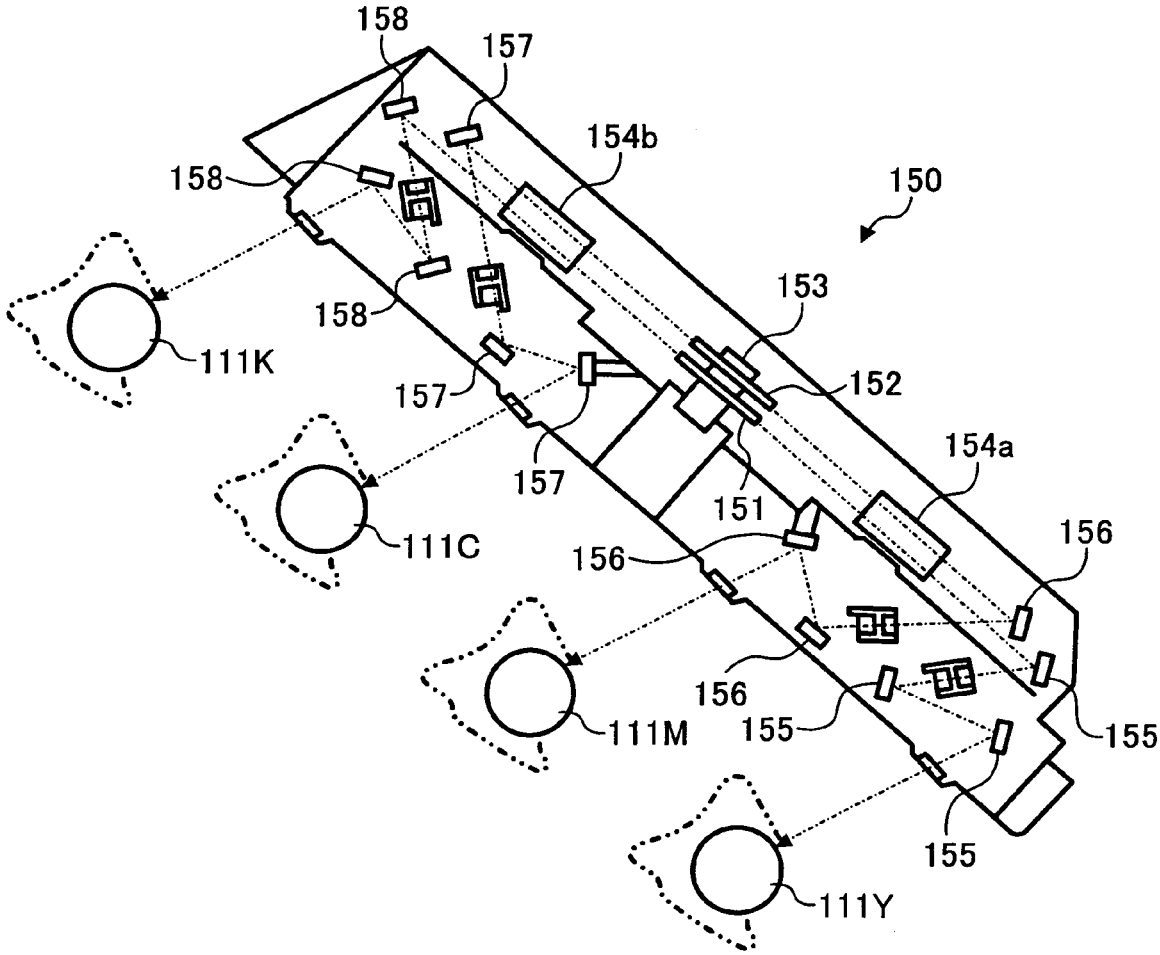
FIG. 9 is a schematic view illustrating an image writing device for use in the image forming apparatus illustrated in FIG. 6.

FIG. 9 is a schematic view for explaining how light images are written on the photoreceptors 111. The light image writing unit 150 includes polygon mirrors 151 and 152 which are rotated by a polygon motor 153 and which reflect laser beams emitted by two laser diodes for forming light images for yellow, magenta, cyan and black color images. The laser beams for yellow, magenta, cyan and black color images are laser light modulated by the yellow, magenta, cyan and black color image data. The laser beams for yellow and magenta color images reflected by the polygon mirrors 151 and 152 pass through a double-layer fθ lens 154*a*. One of the laser beams is reflected by plural mirrors 155 to irradiate the surface of the photoreceptor 111Y. The other of the laser beams is reflected by plural mirrors 156 to irradiate the surface of the photoreceptor 111M.

On the other hand, the laser beams for cyan and black color images reflected by the polygon mirrors 151 and 152 pass through a double-layer fθ lens 154*b*. One of the laser beams is reflected by plural mirrors 157 to irradiate the surface of the photoreceptor 111C. The other of the laser beams is reflected by plural mirrors 158 to irradiate the surface of the photoreceptor 111K.

Thus, the image forming sections 101 form color toner images on the respective photoreceptors 111 in cooperation with the light image writing unit 150. Namely, the image forming sections and light image writing unit constitute a toner image forming means in the printer.

Referring back to FIG. 6, two paper cassettes 161 and 162 are arranged at a bottom portion of the printer. The paper cassettes contain stacks of receiving sheets such as papers. Paper feeding belt units 161*a* and 162*a* are contacted with the uppermost receiving sheets P in the respective cassettes 161 and 162, By timely activating one of the paper feeding belt units 161*a* and 162*a*, the uppermost sheet of the receiving sheets P is fed to the paper feeding passage. The thus fed receiving sheet P is timely fed by the pair of registration rollers 163 which are arranged at an end portion of the paper feeding passage so that the yellow toner image on the photoreceptor 111Y can be transferred to a proper portion of the receiving sheet P by a transfer unit 170.

The transfer unit 170 includes a transfer belt 171 which is rotated counterclockwise by rollers 172, 173, 174 and 175 while contacted with each of the four photoreceptors 111 (i.e., while forming four transfer nips). A roller 176 to which a predetermined voltage is applied by a power source (not shown) is provided so as to face the roller 172. Since the roller 176 applies charges to the transfer belt 171, the receiving sheet P is electrostatically attracted to the surface of the transfer belt 171.

Transfer bias rollers 177 (177Y, 177M, 177C and 177K) are arranged below the respective transfer nips while contacted with the rear surface of the transfer belt 171. A constant current transfer bias is applied to the transfer bias rollers 177 from a power source (not shown), and thereby transfer charges are applied to the transfer belt 171. Therefore, a transfer electric field having a predetermined strength is formed between the transfer belt 171 and the photoreceptors 111 at the transfer nips. The transfer bias rollers 177 can be replaced with another member such as brushes and blades.

As mentioned above, after being stopped once by the pair of registration rollers 163, the receiving sheet P is timely fed by the registration rollers. The receiving sheet P passes the Y, M, C and K transfer nips sequentially so that the Y, M, C and K toner images formed on the respective photoreceptors are transferred on the receiving sheet P by the action of the transfer electric field and the nip pressure. Thus, a full color toner image is formed on the receiving sheet P.

The receiving sheet P bearing the full color toner image is then fed by the transfer belt 171 toward the fixing unit 180. The fixing unit 180 includes a pressure roller 181 which is counterclockwise rotated by a driving means (not shown) and a fixing belt unit 182 which includes a driving roller 183 clockwise rotated by a driving means (not shown), a heating roller 184 containing a heater such as halogen lamps, and a fixing belt 185. The fixing belt 185 is stretched and rotated clockwise by the driving roller 183 and the heating roller 184. The fixing belt 185 is heated by the heating roller 184 at the nip therebetween. The transfer belt 185 and the pressure roller 181 are contacted with each other to form a fixing nip. The receiving sheet P bearing the full color toner image thereon and fed by the transfer belt 171 is heated and pressed at the fig nip. Thus, the full color toner image is fixed on the receiving sheet P.

Then the receiving sheet P is fed to a feeding passage changer (not shown) by which the receiving sheet P is fed to a discharging passage 198 or a reverse drive passage. When the passage is set to the discharging passage 198 by the feeding passage changer, the receiving sheet P is fed into the discharging passage 198. In this case, the receiving sheet P is discharged from the main body and stacked on a discharge tray 197. When the passage is set to the reverse drive passage, the receiving sheet P is fed to the re-feeding unit 195 after passing through the reverse feeding unit 190. The thus reversed receiving sheet P is then fed again to the pair of registration rollers 163. The receiving sheet P is fed again to the transfer unit 170 so that another full color image is formed on the opposite side of the receiving sheet P.

On the other hand, as illustrated in FIG. 7, the surface of the photoreceptor 111Y is cleaned by the cleaning brush 112Y and the counter blade 113Y to remove toner particles remaining on the photoreceptor even after the image transfer process. Then the surface of the photoreceptor 111Y receives discharging light from the discharging lamp (not shown) so that charges remaining on the photoreceptor are decreased. The thus initialized photoreceptor 111Y is ready for the next image forming operations.

The above-mentioned image forming operations are performed when a four-color full color mode is chosen using an operational panel (not shown). When three-color full color mode is chosen, yellow, magenta and cyan color images are formed on a receiving sheet while formation of a black color image is not performed. When a black and white mode is chosen, only the black color image forming operation is performed to form a black color toner image on a receiving sheet P.

Figure 10:
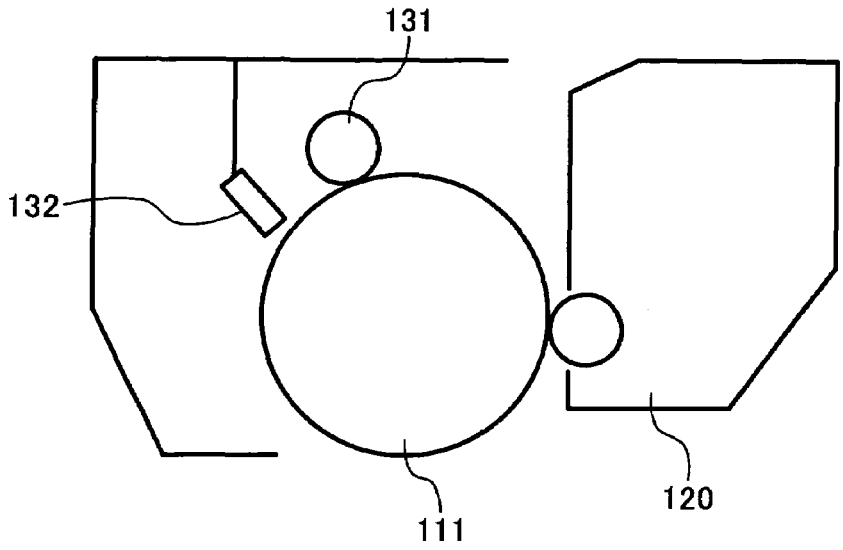
FIG. 10 is a schematic view illustrating an example of the process cartridge of the present invention.

FIG. 10 is a schematic view illustrating an example of the process cartridge of the present invention to which the above-mentioned example of the developing method of the present invention is applied. The process cartridge includes at least a photoreceptor 111 and a developing device 120 each of which is set in the process cartridge while unitized. The process cartridge can be detachably attached to an image forming apparatus such as copiers and printers. As illustrated in FIG. 10, the process cartridge can include a charger 131, a cleaner 132, etc., each of which is set in the process cartridge while unitized. An image forming apparatus including the process cartridge has the same function as that of the image forming apparatus mentioned above referring to FIG. 6.

In this process cartridge, it is preferable that each of the members (such as the photoreceptor and developing device) can be replaced with new one by itself. Therefore, the process cartridge preferably includes a device which allows the developing sleeve to attain a waiting position at which the developing device is not contacted with the photoreceptor when image forming operations are not performed. By using such a device, the replacing operation can be easily performed and in addition a problem in that a toner film is formed on the surface of the developing sleeve can be avoided. Further, the life of the developing device can be prolonged.

Then another example of the developing method of the present invention will be explained.

Figure 11:
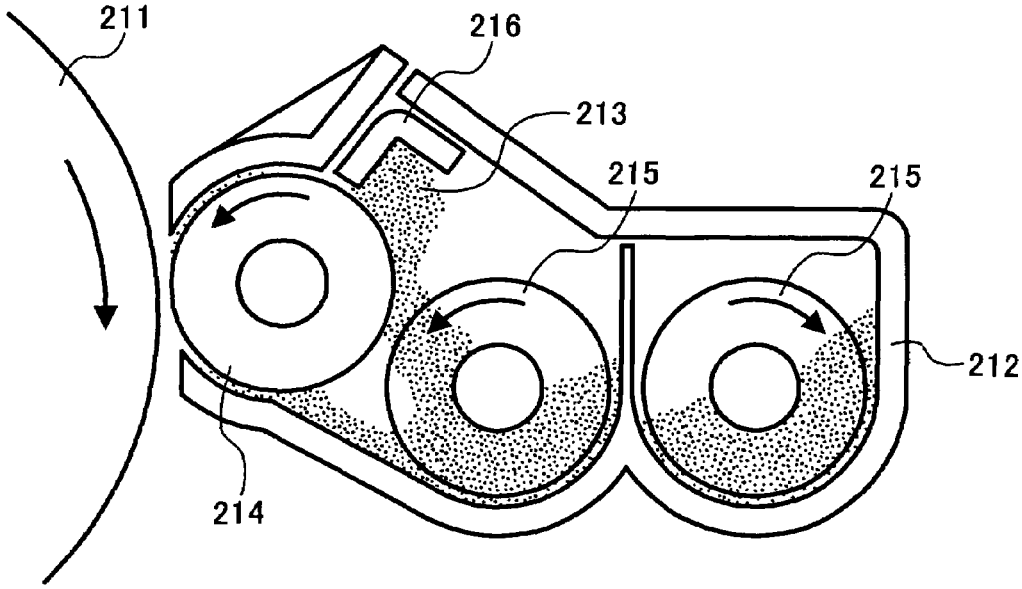
FIG. 11 is a schematic view illustrating another example of the developing device of the present invention.

FIG. 11 is a schematic view illustrating a developing device to which the developing method is applied. The developing device is arranged so as to face a cylindrical photoreceptor 211 which is rotated at a constant speed in a direction indicated by an arrow. The developing device has a case 212 having an opening facing the photoreceptor 211. The developing device also includes a developing sleeve 214 configured to bear a layer of a developer 213 thereon. Apart of the developing sleeve is exposed to the photoreceptor from the opening of the case 212. The developing sleeve is made of a non-magnetic material and includes a magnet roller serving as a magnetic field generating means, which includes magnets and is fixed in the developing sleeve. The developing sleeve 214 has a cylindrical form, and is rotated at a constant speed in the direction indicated by an arrow.

The developer 213 is frictionally charged by being agitated in the developing device, so that negatively charged toner particles are adhered to the surface of positively charged carrier particles. The developer 213 in the case 212 is fed toward the developing sleeve 214 by paddles 215 which are rotated by a motor (not shown) in the directions indicated by respective arrows. In this case, the developer 213 is attracted to the surface of the developing sleeve 214 by the magnet roller therein, and thereby magnetic brushes are formed on the surface of the developing sleeve. Then the thickness of the developer 213 (i.e., the magnetic brushes) is controlled by a doctor blade 216, and the developer layer is fed to the developing region. The toner particles present in the developer layer are adhered to an electrostatic latent image because the developing bias is applied to the developing sleeve 214. Thus, the latent image is developed and a toner image is formed on the photoreceptor 211.

In this example of the developing method, the following relationship (5) is satisfied:

$$A_{nc}/A_t \leqq 0.50 \quad (5)$$

wherein $A_t$ represents the area of the development portion of the image bearing member in the developing region, and $A_{nc}$ represents the area of a carrier-noncontact portion in the development portion with which the magnetic carrier is not contacted when the development portion has no latent image.

The ratio ($A_{nc}/A_t$) is preferably not greater than 0.35.

In addition, the following relationship (6) is satisfied:

$$0.3 \leqq Avc/vs \leqq 1.1 \quad (6)$$

wherein Avc represents the average moving velocity of carrier particles in the two component developer, which carrier particles are contacted with the image bearing member, and vs represents the moving velocity of the surface of the developer bearing member (i.e., the developing sleeve) used.

When the relationships (5) and (6) are satisfied, high quality images having good dot reproducibility and little granularity can be produced. When the ratio ($A_{nc}/A_t$) is too large, the dot reproducibility of the resultant images deteriorates.

When the ratio Avc/vs is too small, the number of contacts of the magnetic brushes with the photoreceptor decreases, and thereby granular images are formed. In contrast, when the ratio Avc/vs is too large, an omission image problem in that the end portions of the resultant images have omissions tends to occur.

As a result of the present inventor's study of distribution of the areas (S) of the carrier-noncontact portions in a development portion of the photoreceptor, with which magnetic carrier particles are not contacted, it is found that when the percentage of the carrier-noncontact portion satisfying a relationship, $S \leqq \pi (Dw/2)^2$ (wherein Dw represents the weight average particle diameter of the magnetic carrier), is not less than 25% by number, high quality images with good dot reproducibility and little granularity can be produced.

In addition, the percentage of the carrier-noncontact portions satisfying a relationship, $S \leqq 1.5\pi (Dw/2)^2$, is not less than 45% by number, high quality images with good dot reproducibility and little granularity can be produced.

In addition, the ratio (vs/vp) of the linear velocity (vs) of the developing sleeve to the linear velocity (vp) of the photoreceptor is preferably from 1.2 to 3 when an alternating electric field is used as the developing bias. When a direct electric field is used as the developing bias, the ratio (vs/vp) is preferably from 2 to 3. When the ratio is too small, the number of contacts of the magnetic brushes with the photoreceptor decreases, and thereby granular images are formed. In contrast, when the ratio is too large, the omission image problem in that the end portions of the resultant images have omissions tends to occur. When it is desired to decrease the ratio for any other reasons, the ratio of spaces in the magnetic brushes is preferably decreased to produce images with little granularity. In this case, the life of the developer can be prolonged. When an alternating electric field is used, the toner particles adhered to the photoreceptor repeat releasing and adhering plural times, and therefore, the lower limit of the ratio (vs/vp) is lower than that in the case using a direct electric field.

In this example of the developing method of the present invention, the developer layer, which is formed on the surface of the developing sleeve by a developer thickness controlling member, preferably has a weight of from 20 to 60 mg/cm$^2$ just after the thickness controlling operation. When the weight of the developing layer is thus controlled, the developer is uniformly packed in the developing region. In addition, the ratio ($A_{nc}/A_t$) of the area ($A_{nc}$) of the carrier-noncontact portion in the development portion with which the carrier is not contacted to the area ($A_t$) of the development portion in the developing region can be decreased. Therefore, images with less granularity can be produced. In contrast, when the weight of the developing layer is too heavy, the developer tends to stay on an upstream side of the developing sleeve in the developing region and thereby the magnetic brushes are contacted with the photoreceptor even at a portion in the developing region, which portion receives only a weak electric field even when a developing bias is applied, resulting in formation of granular images having omissions at the end portions thereof. In this case, the average linear velocity of the moving carrier particles also decreases.

The weight of the developer layer on the developing sleeve can be determined by the method mentioned above.

The magnetic carrier for use in this example of the developing method of the present invention preferably has a weight average particle diameter of from 25 to 45 μm. In addition, it is preferable for the magnetic carrier to include particles having a particle diameter less than 44 μm in an amount of not less than 70% by weight, particles having not less than 62 μm in an amount of less than 1% by weight, and particles having less than 22 μm in an amount of not greater than 7% by weight.

When such a relatively small magnetic carrier is used, the ratio ($A_{nc}/A_t$) the area ($A_{nc}$) of the carrier-noncontact portion in the development portion with which the magnetic carrier is not contacted to the area ($A_t$) of the development portion in the developing region can be decreased. In addition, even when the ratio is constant, the number of particles of the developer contacting the photoreceptor can be decreased. Therefore, latent images can be uniformly developed with toner particles, and thereby images with little granularity can be produced.

It is preferable that the magnetic carrier has a magnetization not less than 76 A·m$^2$/kg at a magnetic field of $1\times10^6/4\pi$ [A/m]. When the magnetization is not less than 76 A·m$^2$/kg, high quality images with less granularity can be produced. When the magnetization is too low, the carrier adhesion problem tends to occur.

The volume resistivity of the magnetic carrier is preferably not less than $1\times10^{12}$ Ω·cm. The magnetic carrier having such a volume resistivity has good developing ability. In addition, the magnetic carrier can develop latent images without causing carrier adhesion problem. Therefore, high quality images with little granularity can be produced.

The toner for use in the developing method of the present invention preferably includes a urea-modified polyester resin. Urea-modified polyester resins are prepared by reacting a polyester prepolymer having an isocyanate group with an amine.

Specific examples of the amines include diamines, polyamines having three or more amino groups, amino alcohols, amino mercaptans, amino acids and blocked amines in which the amines mentioned above are blocked. These amines can be used alone or in combination. Among these amines, diamines and combinations of a diamine with a small amount of polyamine are preferably used.

Specific examples of the diamines include aromatic diamines (e.g., phenylene diamine, diethyltoluene diamine and 4,4'-diaminodiphenyl methane); alicyclic diamines (e.g., 4,4'-diamino-3,3'-dimethyldicyclohexyl methane, diaminocyclohexane and isophoron diamine); aliphatic diamines (e.g., ethylene diamine, tetramethylene diamine and hexamethylene diamine); etc.

Specific examples of the polyamines having three or more amino groups include diethylene triamine, triethylene tetramine, etc. Specific examples of the amino alcohols include ethanol amine, hydroxyethyl aniline, etc. Specific examples of the amino mercaptan include aminoethyl mercaptan, aminopropyl mercaptan, etc. Specific examples of the amino acids include amino propionic acid, amino caproic acid, etc. Specific examples of the blocked amines include ketimine compounds which are prepared by reacting one of the amines mentioned above with a ketone such as acetone, methyl ethyl ketone and methyl isobutyl ketone; oxazoline compounds, etc.

The molecular weight of such urea-modified polyesters can be controlled using an extension inhibitor, if desired. Specific examples of the extension inhibitor include monoamines (e.g., diethyl amine, dibutyl amine, butyl amine and lauryl amine), and blocked amines (i.e., ketimine compounds) prepared by blocking the monoamines mentioned above.

The mixing ratio (i.e., an equivalent ratio [NCO]/[NHx]) of (the [NCO] of) the prepolymer having an isocyanate group to (the [HNx] of) the amine is from 1/2 to 2/1, preferably from 1/1.5 to 1.5/1 and more preferably from 1.2/1 to 1/1.2. When the mixing ratio is too low, the molecular weight of the resultant urea-modified polyester decreases, resulting in deterioration of the hot offset resistance of the resultant toner.

Toners prepared by a pulverization method or a polymerization method can be used for the present invention. However, spherical toners prepared by the following polymerization method are preferably used.

(1) an oil-based dispersion in which a polyester resin having an isocyanate group is dissolved, a colorant is dispersed, and a release agent is dissolved or dispersed is dispersed in an aqueous medium including a particulate inorganic material or a particulate polymer to prepare a toner composition dispersion;
(2) the polyester resin in the above-prepared dispersion is reacted with an amine to prepare a urea-modified polyester resin; and
(3) the solvent included in the dispersion is removed to prepare spherical toner particles.

The thus prepared spherical toner includes the urea-modified polyester resin serving as a binder resin in which the colorant is dispersed at a high concentration.

The urea-modified polyester resin included in the toner preferably has a glass transition temperature of from 40 to 65° C., and more preferably from 45 to 60° C.; a number average molecular weight of from 2,500 to 50,000, and more preferably from 2,500 to 30,000; and a weight average molecular weight of from 10,000 to 500,000, and more preferably from 30,000 to 100,000.

The toner for use in the present invention preferably has a weight average particle diameter (Dw) of from 4 to 8 μm. The ratio (Dw/Dn) of the weight average particle diameter (Dw) to the number average particle diameter (Dn) is preferably from 1 to 1.25. When these properties are controlled so as to be within the ranges, the resultant toner can produce high quality images with high resolution. In order to produce higher quality images, the toner preferably has a property such that toner particles having a particle diameter not greater than 3 μm in an amount of from 1 to 10% by number as well as the above-mentioned properties. In addition, it is more preferable that the weight average particle diameter is from 4 to 6 μm and the ratio (Dw/Dn) is from 1 to 1.15. The toner having such properties has a good combination of high temperature preservability, low temperature fixability and hot offset resistance, and can produce color images with high glossiness. Further, even when the toner is used for a two component developer and the developer is used for a long period of time while the toner is replenished, the particle diameter of the toner hardly changes. Therefore, even when the developer is agitated in a developing device, the developer can maintain good developing ability.

The particles of the toner for use in the present invention preferably have a specific form and a specific form distribution. Specifically, the average circularity of the toner is preferably from 0.9 to 1. The circularity of a toner is determined as follows using a flow-type particle image analyzer FPIA-2000 from Sysmex Corp.:

(1) a suspension including toner particles to be measured is passed through a detection area formed on a plate in the measuring instrument; and
(2) the particles are optically detected by a CCD camera and then the shapes thereof are analyzed with an image analyzer.

The circularity of a particle is determined by the following equation:

$$\text{Circularity}=Cs/Cp$$

wherein Cp represents the length of the circumference of the projected image of a particle and Cs represents the length of the circumference of a circle having the same area as that of the projected image of the particle.

When the average circularity is too small (i.e., the toner has irregular forms), the toner has poor transferability and cannot produce high quality images without toner scattering. A toner having irregular forms has many contact points with a member having a flat surface such as photoreceptors, and thereby charges are concentrated at the tips of the toner particles. Therefore, the toner has higher van der Waals force and image force than spherical toners. Accordingly, when a toner including both toner particles having irregular forms and spherical toner particles is used, the spherical toner particles are selectively transferred to a receiving material, resulting in occurrence of omissions in the resultant images such as character images and line images. Since the toner particles remaining on the photoreceptor even after the transfer process are removed by a cleaning device, the toner yield (i.e., the ratio of the toner particles used for image formation to the total toner particles) decreases. Toners prepared by a pulverization method typically have an average circularity of from 0.91 to 0.92, which is measured by the method mentioned above. In order to prepare a toner having such an average circularity as mentioned above, not only the polymerization methods mentioned above but also known emulsion polymerization methods, suspension polymerization methods and dispersion polymerization methods can be used.

The toner for use in the present invention preferably includes an external additive such as silica and titanium oxide, which is present on the surface of the toner particles. In this case, the physical adherence of toner particles to carrier particles can be decreased and thereby the developing efficiency can be enhanced.

In this example of the developing method of the present invention, the main magnet pole which is located inside the developing sleeve and faces the developing region preferably has a magnetic flux density of from 60 mT to 120 mT (in air) in the normal line direction at the surface of the main magnet pole. When the magnetic flux density is within this range, high quality images with little granularity can be produced even when a direct electric field is applied as a developing bias. When the magnetic flux density is too large, the area of the carrier-noncontact portion in which the magnetic carrier is not contacted with a portion of the development portion of the photoreceptor decreases, and thereby granular images tend to be produced. In contrast when the magnetic flux density is too small, the carrier adhesion problem tends to occur because the magnetic carrier is weakly bounded to the developing sleeve. The magnetic flux density can be measured with a three-dimensional magnetism measuring instrument (from Excel System Product Co., Ltd.). The measurement method is as follows.

(1) the probe 11TS-0A (from ADS Co., Ltd.) is set on a surface of the developing sleeve so as to face the main magnetic pole; and (2) the magnetic flux density is measured using a gauss meter HGM-8905 (from ADS Co., Ltd.) while the magnet is rotated and the developing sleeve is not rotated.

The angle (hereinafter referred to as the main pole angle) formed by the normal line at the surface of the main magnetic pole and the common normal line of the developing sleeve and the photoreceptor is from 3° to 7° in the direction opposite to the rotation direction of the developing sleeve. When the main pole angle is too high in this direction, the developer tends to stay at the developing region. In contrast, when the main pole angle is too low, a space is formed between the magnetic brushes and the photoreceptor when the magnetic brushes fall, and thereby granular images are produced.

Figure 12:
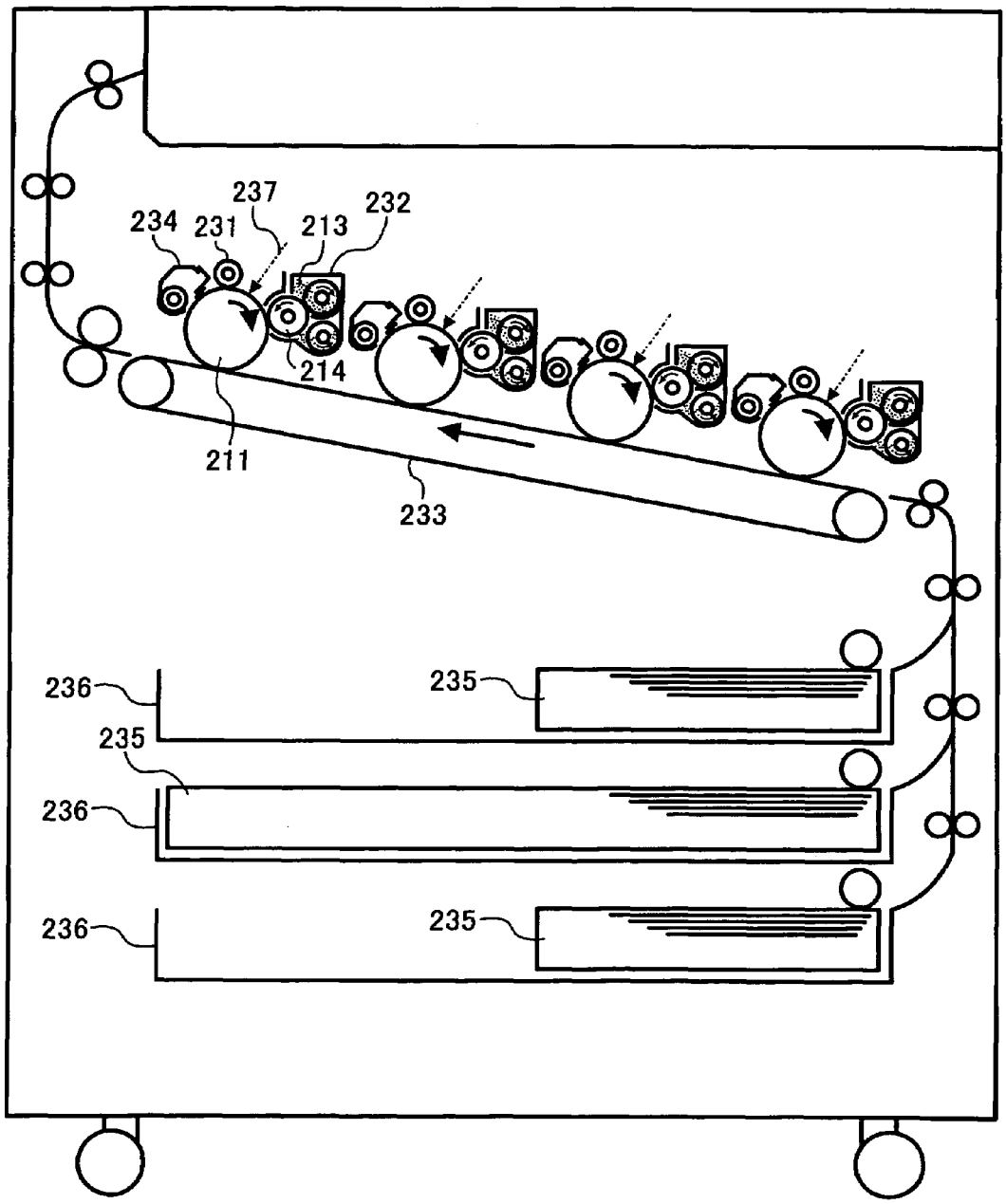
FIG. 12 is a schematic view illustrating another example of the image forming apparatus of the present invention.

FIG. 12 is a schematic view illustrating an image forming apparatus for which this example of the developing method is used. Referring to FIG. 12, the image forming apparatus includes four image forming sections each including a photoreceptor 211, and a charger 231, a light irradiator (not shown), a developing device 232, a transfer device 233, a cleaning device 234 and a discharger (not shown) which are arranged around the photoreceptor 211. In addition, a paper feeding device (not shown) configured to feed a sheet of a receiving material 235 from a paper tray 236 to a point at which the photoreceptors 211 face the transfer device 233, and a fixer (not shown) configured to fix a toner image which is transferred from the photoreceptor 211 onto the sheet of the receiving material 235 after the receiving material sheet is released from the photoreceptor.

The image forming operation of an image forming section of the image forming apparatus will be explained referring to FIG. 12. The photoreceptor 211, which is rotated in the direction indicated by an arrow, is charged by the charger 231, and then exposed to imagewise light 237 emitted by the light irradiator. Thus, an electrostatic latent image is formed on the surface of the photoreceptor. In this case, the lighted portions are the image portions and the non-lighted portions are the background portions. The thus prepared electrostatic latent image is developed by the developing method mentioned above using a developer 213 including a magnetic carrier and a toner. In this case, a developing bias is applied to a developing sleeve 214 of the developing device 232 by a power source (not shown). Thus, a toner image is formed on the surface of the photoreceptor 211. The toner image is transferred to the receiving material 235, which is fed from the paper tray 236, by the transfer device 233, and the toner image is then fixed on the receiving material 235 by the fixing device. In this regard, the toner image can be transferred to the receiving material 235 via an intermediate transfer medium. Toner particles remaining on the surface of the photoreceptor 211 without being transferred are removed by the cleaning device 234 and the collected toner particles are contained in the cleaning device 234. Then charges remaining on the photoreceptor are discharged by the discharger. Then the photoreceptor 211 is repeatedly subjected to the image forming processes.

This example of the developing method of the present invention can also be used for a process cartridge. The process cartridge has such a configuration as illustrated in FIG. 10. The process cartridge is detachably attached to an image forming apparatus which has such a function as that of the image forming apparatus illustrated in FIG. 12.

Figure 13A:
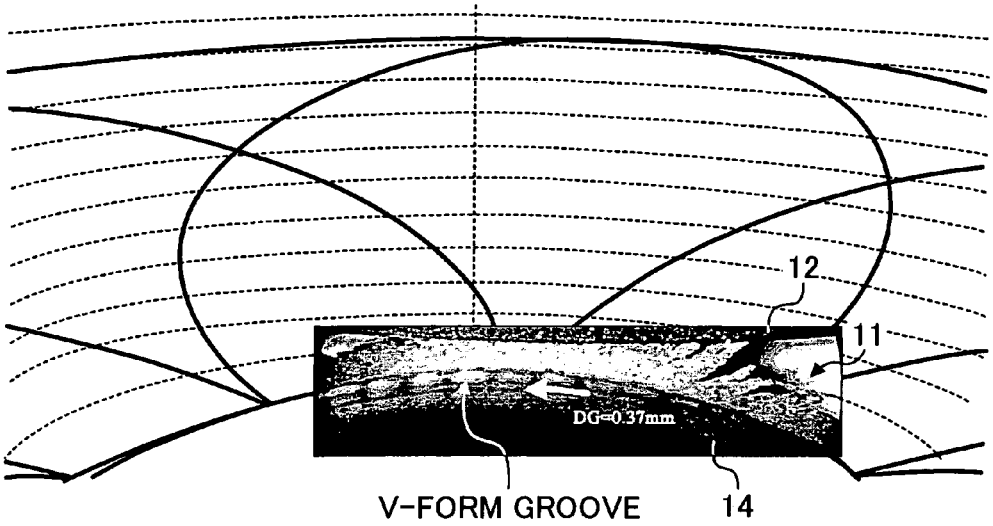
FIGS. 13A and 13B are schematic views and photographs for explaining two examples of the developing method of the present invention.
Figure 13B:
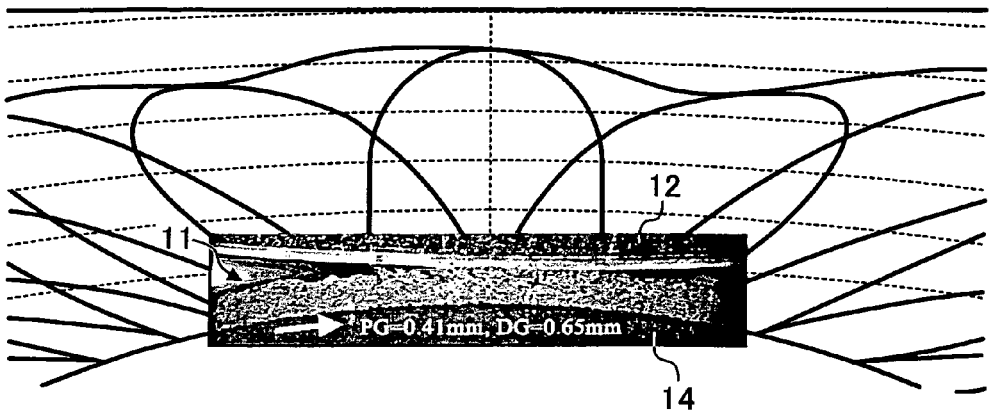

FIGS. 13A and 13B are schematic views for explaining the difference between the two examples of the developing method of the present invention. In FIGS. 13A and 13B, characters DG and PG represent the doctor gap (i.e., the gap between the tip of the doctor for controlling the thickness of the developer layer and the surface of the developing sleeve and the development gap between the surface of the photoreceptor and the developing sleeve, respectively. In the first-mentioned example of the developing method as illustrated in FIG. 13A, long magnetic brushes 11 are formed on the developing sleeve 14 in the developing region and the body portions of the magnetic brushes are contacted with the photoreceptor 12 instead of the tips of the magnetic brushes. Therefore, the developer tends to stay before the developing region. Therefore, the ratio ($A_{nc}/A_t$) of the area ($A_{nc}$) of the carrier-noncontact portion in the development portion with which the carrier is not contacted to the area ($A_t$) of the development portion in the developing region increases.

In contrast, in the second-mentioned example of the developing method as illustrated in FIG. 13B, relatively short magnetic brushes 11 are formed on the developing sleeve 14 in the developing region and the tip portions of the magnetic brush are contacted with the photoreceptor 12. In this case, the magnetic brushes are contacted with the photoreceptor in good order as the photoreceptor is rotated while the tips of the magnetic brushes are slightly collapsed. Therefore, the ratio ($A_{nc}/A_t$) of the area ($A_{nc}$) of the carrier-noncontact portion in the development portion with which the carrier is not contacted to the area ($A_t$) of the development portion in the developing region decreases.

Whether the first-mentioned or second-mentioned developing method is performed depends on the attenuation rate of the density of magnetic flux formed in the normal line direction of the surface of the main pole; the diameter of the photoreceptor; and the surface conditions of the developing sleeve.

Specifically, when the magnetic flux density is less than 40%, the length of the magnetic brushes increases, and thereby the magnetic brushes tend to stay in the developing region, resulting in increase of the ratio ($A_{nc}/A_t$). In this regard, the attenuation rate is defied as a ratio ($MFD_1/MFD_P$), wherein $MFD_P$ represents a peak value of the density of magnetic flux formed in the normal direction of the surface of the developing sleeve, and $MFD_1$ represents the density of magnetic flux formed in the normal direction of a point apart from the surface of the developing sleeve by 1 mm. When grooves having a V-form or a U-form are formed on the surface of the developing sleeve as illustrated in FIG. 13A, the same effect can be produced (i.e., the first-mentioned developing method is performed).

In contrast, when the attenuation rate is not less than 40%, the length of the magnetic brushes decreases, and thereby the magnetic brushes hardly stay in the developing region, resulting in decrease of the ratio ($A_{nc}/A_t$). In addition, when the surface of the developing sleeve is subjected to a sand blasting treatment or the photoreceptor has a diameter of not greater than 30 mm, the same effect can be produced (i.e., the second developing method is performed).

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

At first, the first example of the developing method of the present invention will be explained referring to specific examples.

Preparation of Carrier A

At first, a silicone resin solution SR2411 (from Dow Corning Toray Silicone Co., Ltd.) was diluted to prepare a 5% silicone resin solution. Then 5 kg of a core material (a MnMgSr ferrite) having an average particle diameter of 36 μm and a magnetization of 77 $A \cdot m^2/kg$ at a magnetic field of $1 \times 10^6/4\pi$ [A/m] was coated with the above-prepared silicone resin solution using a fluidized bed type coating machine. The coating conditions are as follows.

Temperature: 100° C.

Coating time: about 40 g/min

The thus coated core material was then heated at 240° C. for 2 hours. Thus, a carrier A which has a silicone resin layer having a thickness of 0.53 μm and which has a true specific gravity of 5.0 was prepared. The thickness of the resin layer was controlled by controlling the amount of the coating liquid supplied to the coating machine.

Preparation of Carrier B

At first, a silicone resin solution SR2411 (from Dow Corning Toray Silicone Co., Ltd.) was diluted to prepare a 5% silicone resin solution. Then 5 kg of a core material MgMnSr ferrite having an average particle diameter of 60 μm and a magnetization of 77 $A \cdot m^2/kg$ at a magnetic field of $1 \times 10^6/4\pi$ [A/m] was coated with the above-prepared silicone resin solution using a fluidized bed type coating machine. The coating conditions are as follows.

Temperature: 100° C.

Coating time: 40 g/min

The thus coated core material was then heated at 240° C. for 2 hours. Thus, a carrier B which has a silicone resin layer having a thickness of 0.53 μm and which has a true specific gravity of 5.0 was prepared. The thickness of the resin layer was controlled by controlling the amount of the coating liquid supplied to the coating machine.

A printer having such a configuration as illustrated in FIG. 6 was used as an evaluating machine. This printer includes a developing sleeve having one hundred V-form grooves each having a depth of 70 μm on the surface thereof. In addition, the developing sleeve includes a magnet roller having five magnetic poles, P1, P2, P3, P4 and P5. Among these magnetic poles, the magnetic pole P1 is the main pole, which faces the photoreceptor and which attracts the developer so as to be located on the surface of the developing sleeve. The magnetic pole P5 is a doctor-opposing magnetic pole, which faces the doctor blade configured to scrape the developer to control the thickness of the developer layer on the developing sleeve and which also attracts the developer such that the developer is located on the surface of the developing sleeve.

Figure 14A:
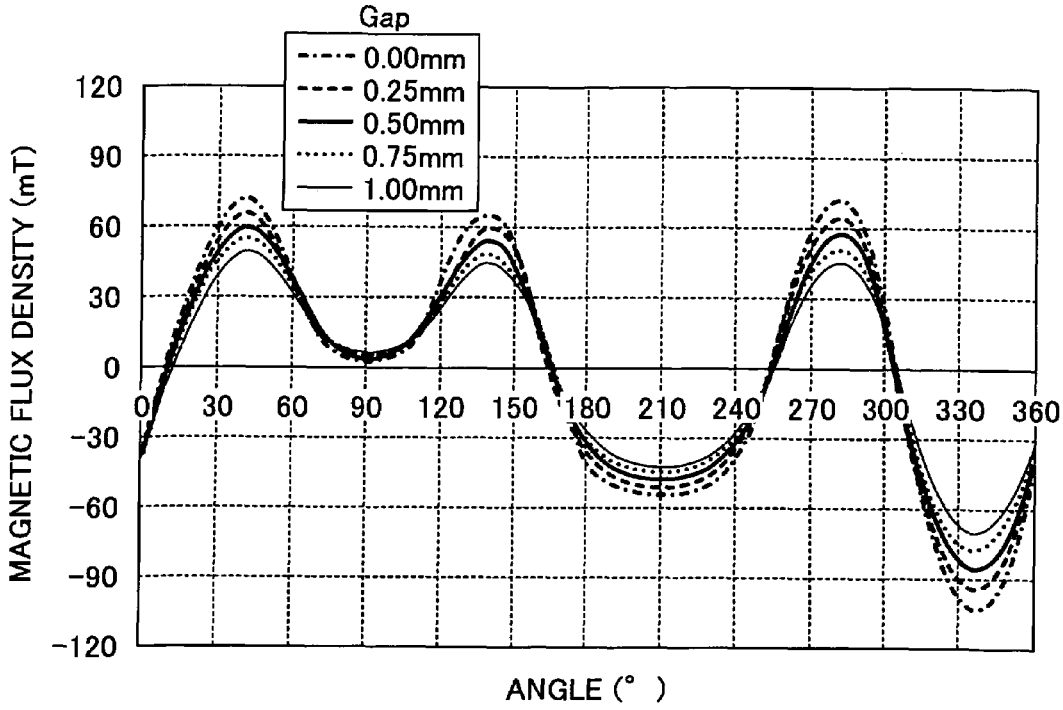
FIGS. 14A and 14B are graphs illustrating the magnetic flux density at five points over the developing sleeve used for the first example of the developing method of the present invention.
Figure 14B:
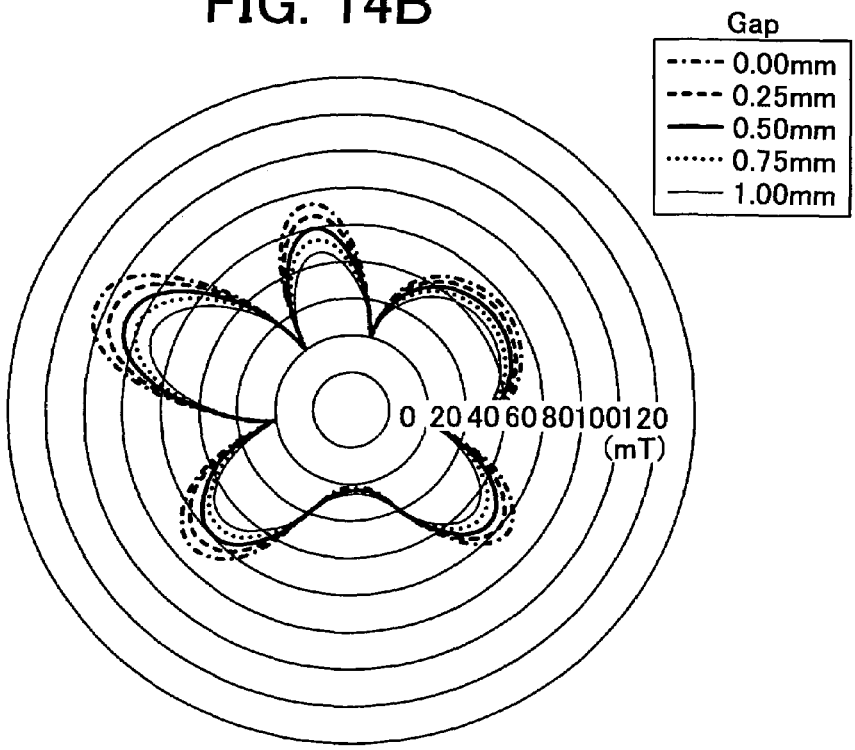

In this case, the magnetic flux densities in the normal line direction at five points which are apart from the surface of the developing sleeve by a distance (i.e., gap) of 0, 0.25 mm, 0.50 mm, 0.75 mm and 1.0 mm are measured using a gauss meter HGM-8300 (manufactured by ADS Co., Ltd.) and an axial probe A1 (manufactured by ADS Co., Ltd.). The results are shown in FIGS. 14A and 14B. Magnetic flux densities in the normal line direction are measured at an interval of 0.1° by rotating the magnet by 360° while fixing the probe at one of the points.

Figure 15:
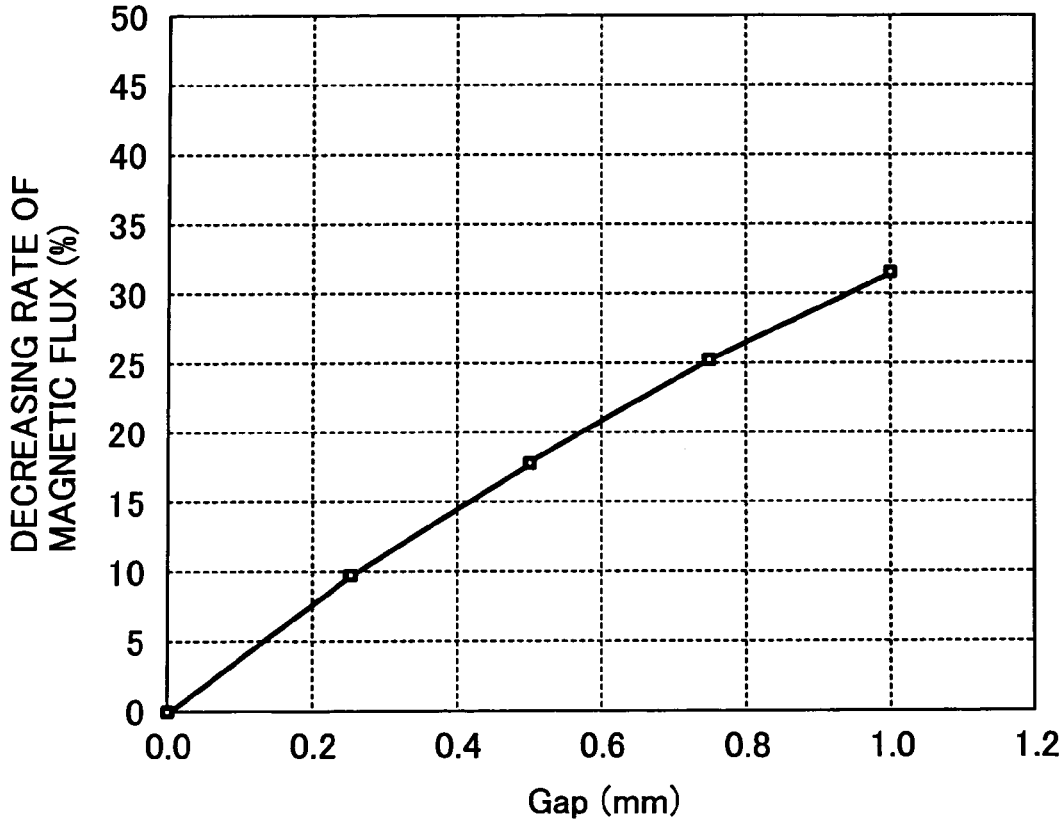
FIG. 15 is a graph illustrating the decreasing rate of magnetic flux density of the developing sleeve used for the first example of the developing method of the present invention.

FIG. 15 is a graph showing the relationship between the gap (mm) and the decreasing rate (%) of the magnetic flux density (100×(Mmax−M)/Mmax) wherein Mmax represents the peak magnetic flux density and M represents the magnetic flux at a point). In this case, the attenuation rate of the magnetic flux density (i.e., the decreasing rate of the magnetic flux density at a point apart from the surface of the developing sleeve by 1 mm) is 32%.

The other conditions of the printer are as follows.

Diameter of the developing sleeve: 18 mm

Linear velocity of the developing sleeve: 490 mm/sec (absolute value)

Diameter of the photoreceptor: 30 mm

Linear velocity of the photoreceptor: 245 mm/sec (absolute value)

Development gap between the photoreceptor and the developing sleeve: 0.4 mm

Doctor gap between the doctor blade and the developing sleeve: 0.55 mm

Weight of developer layer on the developing sleeve: 50 $mg/cm^2$

Main pole angle: 7°

Magnetic flux density of the main pole (P1); 100 mT

Magnetic flux density of the magnetic pole (P5): 70 mT

Initial potential $V_0$ of photoreceptor: −520 V

Potential of the lighted portion of photoreceptor: −50 V

Developing bias $V_B$: −400 V (DC)

Example 1

Preparation of Toner

A polymerization toner was prepared as follows. At first, 450 g of a 0.1M aqueous solution of $Na_3PO_4$ was added to 710 g of ion-exchange water, and the mixture was heated to 60° C. Then the mixture was agitated with a TK HOMOMIXER (from Tokushu Kika Kogyo Co., Ltd.) at a revolution of 12,000 rpm. Then 68 g of a 1.0 M aqueous solution of $CaCl_2$ was gradually added thereto. Thus, an aqueous medium including $Ca_3(PO_4)_2$ was prepared.

On the other hand, 170 g of styrene, 30 g of n-butyl acrylate, 10 g of a quinacridone type magenta pigment, 2 g of a di-t-butylsalicylic acid metal compound and 10 g of a polyester resin were mixed and the mixture was heated to 60° C. Then the mixture was agitated with a TK HOMOMIXER at a revolution of 12,000 rpm. Further, 10 g of a polymerization initiator, 2,2'-azobis(2,4-dimethylvalelonitrile), was added thereto. Thus, a polymerizable monomer composition liquid was prepared.

The thus prepared polymerizable monomer composition liquid was added to the above-prepared aqueous medium. Under a nitrogen gas flow, the mixture was agitated for 20 minutes at 60° C. using a TK HOMOMIXER, which was rotated at a revolution of 10,000 rpm. Thus, the polymerizable monomer composition was granulated, i.e., an emulsion including granulated polymerizable monomer composition was prepared. Then the emulsion was heated for 10 hours at 80° C. while agitated with a paddle agitator to perform a reaction. After the reaction, part of water of the aqueous medium was removed therefrom under a reduced pressure, followed by cooling. Thus, a dispersion including toner particles was prepared. Then hydrochloric acid was added to the dispersion to dissolve calcium phosphate. After the dispersion was subjected to filtering, the obtained toner particles were washed with water, and then dried. Thus, toner particles which have a weight average particle diameter of 7 μm and includes particles having a particle diameter not greater than 3 μm in an amount of 1% by number were prepared.

Then 20 kg of the thus prepared toner particles was mixed with 100 g of a hydrophobized particulate silica having an average particle diameter of 0.3 μm and 100 g of a hydrophobized particulate titanium oxide having an average particle diameter of 0.3 μm, and the mixture was agitated. Thus, a toner was prepared. The toner has the following properties.

Weight average particle diameter (Dw): 7.0 μm

Number average particle diameter (Dn): 6.5 μm

Ratio (Dw/Dn): 1.077

Percentage of fine particles having a particle diameter of 3 μm: 1% by number

The particle diameter distribution of the toner was determined by the small hole passage method (i.e., a method using a COULTER COUNTER) mentioned above. The number average particle diameter (Dn) and the weight average particle diameter (Dw) were determined by the particle diameter distribution. In this regard, the number average particle diameter (Dn) was determined by averaging particle diameters of 50,000 particles.

The carrier A prepared above was mixed with the toner such that the concentration of the toner is 7% by weight to prepare a developer. The developer was set in the printer, and images having solid images and half tone images were produced. The granularity and dot reproducibility of the images were evaluated.

Evaluation Method

The granularity of an image is determined as follows.

(1) at first, a half-tone image is read with a scanner to prepare a patch having an area of about 1 $cm^2$;

(2) the image is subjected to a Fourier transformation treatment to prepare a power spectrum;

(3) the power spectrum is then subjected to a frequency filtering treatment so as to be compensated to match us well with human visual characteristics; and.

(4) the compensated power spectrum is integrated, to determine the granularity of the image of the patch.

In this case, the granularities of the patches having a brightness of from 40 to 80% were averaged to obtain an average value, which is the granularity of the image. When the granularity is less than 0.46 (○), the (half tone) image looks even (i.e., the image does not look granular). In contrast, when the granularity is not less than 0.46 (×), the image looks granular.

Evaluation of dot reproducibility of an image was performed by observing dot images constituting an image with a microscope of 100 power magnification to determine whether the areas of the dot images are different from each other. The dot reproducibility was graded as follows.

○: The ratio ((Amax−Amin)/Amax) of difference (Amax−Amin) between the area (Amax) of a dot having a maximum area and the area (Amin) of a dot having a minimum area to the maximum area (Amax) is less than 0.30 (the developer is on a good level).

Δ: The ratio ((Amax−Amin)/Amax) is from 0.30 to 0.60 (the developer is on such a level as to be practically used).

×: The ratio ((Amax−Amin)/Amax) is greater than 0.60 (the developer is on such a level as not to be practically used).

In addition, the developer was set in the observation system having such a configuration as illustrated in FIG. 2 to check the behavior of the developer (i.e., the magnetic brushes) in the developing region in the developing process and to determine the ratio of the area of the carrier-noncontact region to the area of the development portion.

Specifically, a transparent glass drum having a diameter of 30 mm was used as the substitute for the photoreceptor. The developing sleeve was arranged so as to face the glass drum while being apart from the surface of the glass drum by the predetermined gap (i.e., 0.4 mm). As illustrated in FIG. 2, a glass drum having an arch form having a length of one fourth of the peripheral length of a cylindrical drum was used such that the developing region can be observed. The glass drum can be moved at the same speed as that of the photoreceptor. In order that the surface of the glass drum has an image portion and a non-image portion, which have different potentials, transparent electrodes are formed on the surface of the glass drum while a voltage is applied to the electrode. Further, an outermost layer which is the same as the outermost layer of the photoreceptor is formed on the surface of the glass drum such that the surface of the glass drum has the same friction coefficient as that of the surface of the photoreceptor.

The tip portion of the magnetic brushes observed with the observation system was enlarged with a stereomicroscope SZ60 from Olympus Optical Co., Ltd. and the images were caught by a high speed camera ULTIMA II from Photron Ltd. The thus caught images were binarized using an image analyzing software, IMAGE HYPER II from DigiMo, while the threshold level is properly set to distinguish the carrier contact regions from the carrier noncontact regions. Since the carrier-noncontact region changes as the magnetic brushes moves, the images in a certain time are processed to determine areas of the carrier noncontact regions in each image, the average area of the carrier noncontact regions and the number of carrier-noncontact regions in each image.

Example 2

The procedure for image formation and evaluation using the toner and the carrier A in Example 1 were repeated except that the weight of the developer layer on the developing sleeve was changed to 70 mg/$cm^2$. The weight of the developer layer can be changed by changing the linear velocities of the developing sleeve and the photoreceptor, physical properties of the toner and the carrier, the toner concentration of the developer, the development gap, the gap (the doctor gap) between the doctor blade and the developing sleeve, the shape of the grooves formed on the developing sleeve, etc. in Example 2, the doctor gap was changed so that the developer layer has a weight of 70 mg/$cm^2$.

Example 3

The procedure for image formation and evaluation using the toner and the carrier A in Example 1 were repeated except that the weight of the developer layer on the developing sleeve was changed to 30 mg/$cm^2$.

Comparative Example 1

The procedure for image formation and evaluation using the toner and the carrier A in Example 1 were repeated except that the weight of the developer layer on the developing sleeve was changed to 75 mg/cm$^2$.

Comparative Example 2

The procedure for image formation and evaluation using the toner and the carrier A in Example 1 were repeated except that the carrier A was replaced with the carrier B.

The results are shown in Table 1.

TABLE 1

| | Anc/At (%) | PER 1* (%) | PER 2*[2] (%) | Avc/vs | PER 3*[3] (%) | PER 4*[4] (%) | GRA*[5] | DOT*[6] |
|---|---|---|---|---|---|---|---|---|
| Ex. 1 | 51.5 | 19.3 | 44.9 | 1.04 | 98.98 | 91.81 | ○ | ○ |
| Ex. 2 | 32.2 | 34.4 | 73.0 | 0.82 | 95.06 | 90.00 | ○ | ○ |
| Ex. 3 | 69.1 | 12.9 | 31.7 | 1.09 | 99.52 | 94.39 | ○ | ○ |
| Comp. Ex. 1 | 28.2 | 49.3 | 88.6 | 0.71 | 92.34 | 79.88 | X | ○ |
| Comp. Ex. 2 | 70.1 | 9.9 | 38.2 | 0.95 | 97.81 | 89.65 | X | Δ |

PER 1*: Percentage of the areas satisfying $S \leqq \pi (Dw/2)^2$
PER 2*[2]: Percentage of the areas satisfying $S \leqq 5 \pi (Dw/2)^2$
PER 3*[3]: Percentage of the carrier particles satisfying $vp \leqq vc \leqq 2vs$
PER 4*[4]: Percentage of the carrier particles satisfying $0.625 \leqq vc/vs \leqq 1.5$
GRA*[5]: Granularity of the image
DOT*[6]: Dot reproducibility of the image In the printer mentioned above, the combination of the powder pump, the toner container, the controller, etc. serves as toner supplying means for supplying toners to the developing regions of the respective developing devices. In addition, the toner container serves as toner containing means for containing a toner therein. Further, a motor configured to generate the driving force for rotating the developing sleeve, a drive transmitter configured to transmit the rotation driving force of the motor to the developing sleeve, another motor configured to generate the driving force for rotating the photoreceptor, another drive transmitter configured to transmit the rotation driving force of the motor to the photoreceptor, a controller configured to control the motors, etc. constitute the driving means for rotating the developing sleeve and the photoreceptor.

The ratio (Anc/At) can be changed by changing the development gap, the doctor gap, physical properties of the carrier and toner used, the toner concentration of the developer, the linear velocities of the developing sleeve and the photoreceptor, etc. By properly controlling one or more of these parameters, the ratio (Anc/At) can be controlled so as to be in the range of from 30 to 70%. Since the toner concentration changes, the toner concentration is preferably controlled so that the ratio (Anc/At) can be controlled so as to be in the range of from 30 to 70% by properly controlling the toner replenishing conditions. In addition; choice of the toner and carrier is committed to users. However, by using the toner and carrier mentioned above, the ratio (Anc/At) can be certainly controlled so as to be in the range of from 30 to 70%.

The image forming apparatus of the present invention can have both a high quality image mode in which the image quality has a higher priority than the image forming speed and a high speed mode in which the image forming speed has a higher priority than the image quality. In this case, the ratio (Anc/At) is controlled so as to be in the range of from 30 to 70% at least when the high quality image mode is adopted.

It is preferable to ship the image forming apparatus in combination with the toner, carrier and/or developer mentioned above which satisfy the above-mentioned conditions such as particle diameter, magnetization, charge quantity, etc. Alternatively, it is also preferable that such toner and carrier are can be handled as a special toner and a special carrier by distinguishing the product names and/or product numbers from other toners and carriers.

Then, the second example of the developing method of the present invention will be explained referring to specific examples.

Examples 4 and 5 and Comparative Examples 3 and 4

At first, a toner was prepared as follows.

The following components were contained in a reaction vessel equipped with a condenser, a stirrer and a nitrogen feed pipe and reacted for 8 hours at 230° C. under a normal pressure.

| | |
|---|---|
| Ethylene oxide (2 mole) adduct of bisphenol A | 724 parts |
| Isophthalic acid | 250 parts |
| Terephthalic acid | 24 parts |
| Dibutyl tin oxide | 2 parts |

Then the reaction was further continued for 5 hours under a reduced pressure of from 10 to 15 mmHg. After being cooled to 160° C., the reaction product was mixed with 32 parts of phthalic anhydride and the mixture was reacted for 2 hours. After being cooled to 80° C., the reaction product was reacted with 188 parts of isophorone diisocyanate for 2 hours in ethyl acetate. Thus, a polyester prepolymer having a weight average molecular weight of 12,000 was prepared.

In a reaction vessel equipped with a stirrer and a thermometer, 30 parts of isophorone diamine and 70 parts of methyl ethyl ketone were mixed and reacted for 5 hours at 50° C. to prepare a ketimine compound.

The following components were contained in a reaction vessel equipped with a condenser, a stirrer and a nitrogen feed pipe and reacted for 6 hours at 230° C. under a normal pressure.

| | |
|---|---|
| Ethylene oxide (2 mole) adduct of bisphenol A | 724 parts |
| Terephthalic acid | 276 parts |

Then the reaction was further continued for 5 hours under a reduced pressure of from 10 to 15 mmHg while the generated water was removed. Thus, an unmodified polyester having a peak molecular weight of 6,000, and an acid value of 3.8 mgKOH/g was prepared.

The following components were mixed in a beaker to prepare a resin solution.

| | |
|---|---|
| Polyester prepolymer prepared above | 15.4 parts |
| Unmodified polyester resin prepared above | 64 parts |
| Ethyl acetate | 78.6 parts |

Then the following components were added to the resin solution prepared above.

| | |
|---|---|
| Dibasic acid wax (AV121 from Toakasei Co., Ltd., which serves as a wax having a relatively high acid value) | 5 parts |
| Low molecular weight polyethylene (from Sanyo Chemical Industries Ltd., serving as a wax having a low acid value, acid value of 0 mgKOH/g) | 10 parts |
| Copper phthalocyanine blue pigment | 4 parts |

After being heated to 60° C., the mixture was agitated, using a TK HOMOMIXER which is rotated at a revolution of 12,000 rpm to prepare a dispersion. Then 2.7 parts of the ketimine compound prepared above was added thereto. Thus, a toner composition liquid was prepared.

On the other hand, the following components were mixed in a beaker to prepare an aqueous medium.

| | |
|---|---|
| Ion-exchange water | 706 parts |
| 10% suspension of hydroxyapatite (SUPERTITE 10 from The Nippon Chemical Industrial Co., Ltd.) | 294 parts |
| Sodium dodecylbenzenesulfonate | 0.2 parts |

After the aqueous medium was heated to 60° C. while agitated with a TK HOMOMIXER at a revolution of 12,000 rpm, the toner composition liquid prepared above was added to the aqueous medium. The mixture was further agitated for 10 minutes using the TK HOMOMIXER.

Then the mixture was contained in a beaker equipped with a stirrer and a thermometer, and the mixture was heated to 98° C. After the mixture was subjected to an addition polymerization at 98° C. while the solvent included therein was removed, the reaction product was filtered. The thus prepared particles were washed and dried, followed by air classification. Thus, toner particles were prepared. The toner particles were mixed with 0.5 parts of a silica and 0.5 parts of a titanium oxide using a HENSCHEL MIXER. Thus, a toner having a weight average particle diameter (Dw) of 6 μm, a ratio (Dw/Dn) of 1.15 and an average circularity of 0.97 was prepared.

Then a two component developer was prepared by mixing the toner with a carrier having the following properties:

Weight average particle diameter: 36.1 μm

Content of particles having a particle diameter less than 44 μm: 78.6% by weight Content of particles having a particle diameter greater than 62 μm: 0.8% by weight Content of particles having a particle diameter less than 22 μm: 6.2% by weight Magnetization: 77 $A \cdot m^2/kg$ at a magnetic field of $1 \times 10^6/4\pi$ [A/m]

Volume resistivity: $2.51 \times 10^{15}$ Ω·cm

The developer was set in an image forming apparatus to produce images. The image forming conditions were as follows.

Developing sleeve: Aluminum drum whose surface is subjected to sand blasting

Diameter of developing sleeve: 30 mm

Magnetic flux of main magnetic pole: 85 mT (in the normal direction at the surface thereof, and in air);

Distribution of magnetization of main magnetic pole: 14° (half width angle)

Diameter of photoreceptor: 90 mm

Potential of non-image portion of photoreceptor: −640V

Potential of image portion of photoreceptor: −130V

Developing bias: −470V (DC)

Development gap: 0.3 mm

Weight of developer on the developing sleeve: 70 $mg/cm^2$

Linear velocity of photoreceptor: 245 mm/sec

Figure 16A:
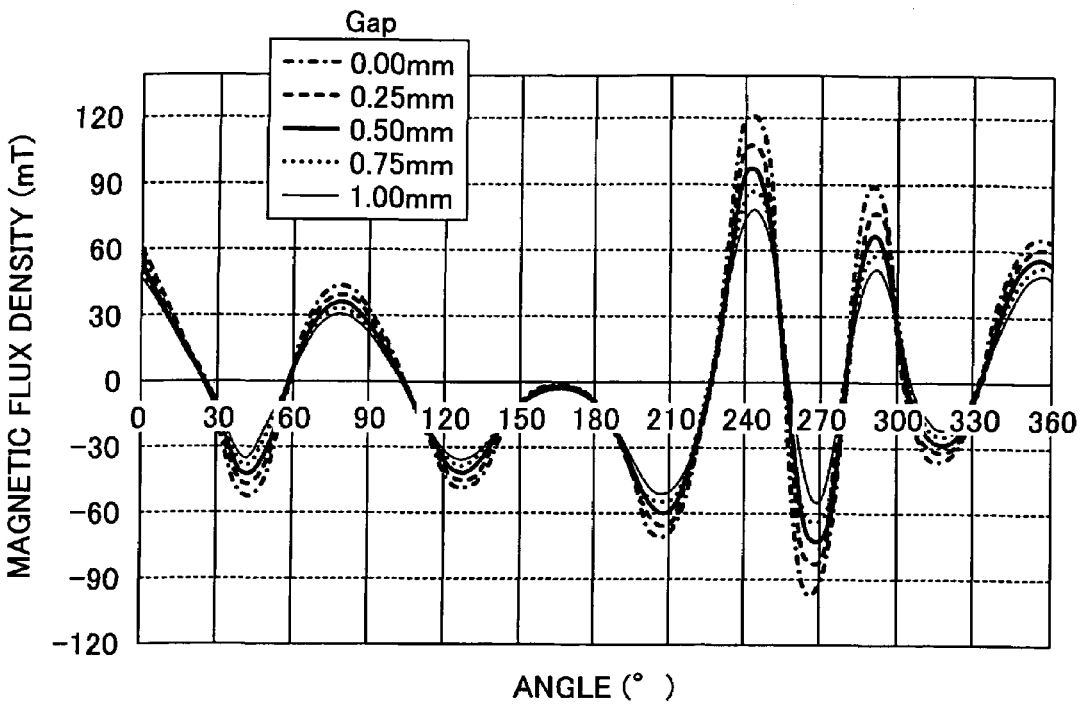
FIGS. 16A and 16B are graphs illustrating the magnetic flux density at five points over the developing sleeve used for the second example of the developing method of the present invention.
Figure 16B:
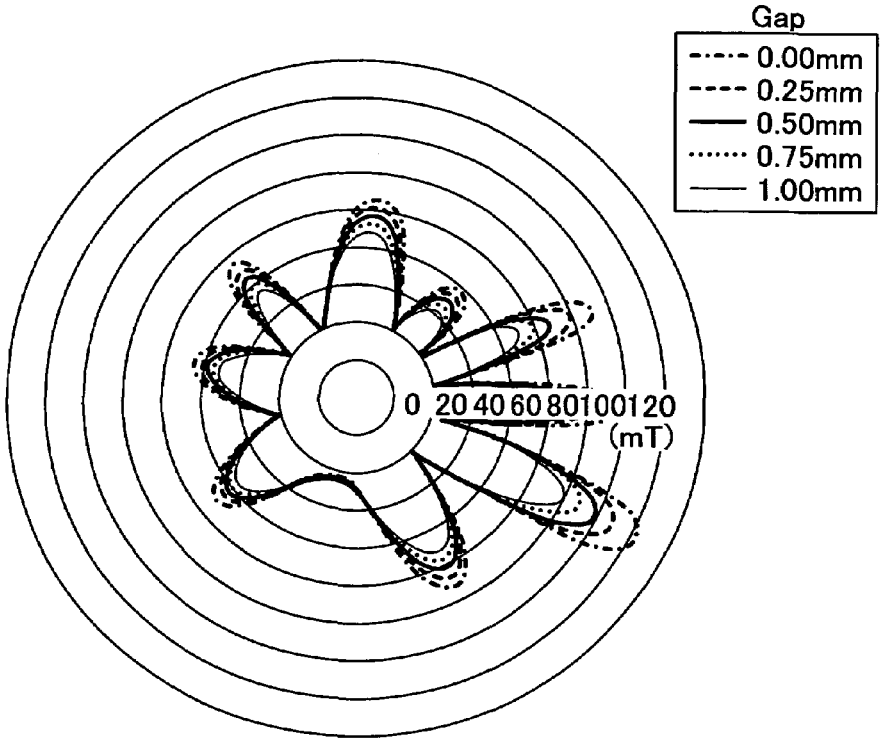

In this case, the magnetic flux densities in the normal line direction at five points which are apart from the surface of the developing sleeve by a distance (i.e., gap) of 0, 0.25 mm, 0.50 mm, 0.75 mm and 1.0 mm are measured using a gauss meter HGM-8300 (manufactured by ADS Co., Ltd.) and an axial probe A1 (manufactured by ADS Co., Ltd.). The results are shown in FIGS. 16A and 16B. Magnetic flux densities in the normal line direction are measured at an interval of 0.1° by rotating the magnet by 360° while fixing the probe at one of the points.

Figure 17:
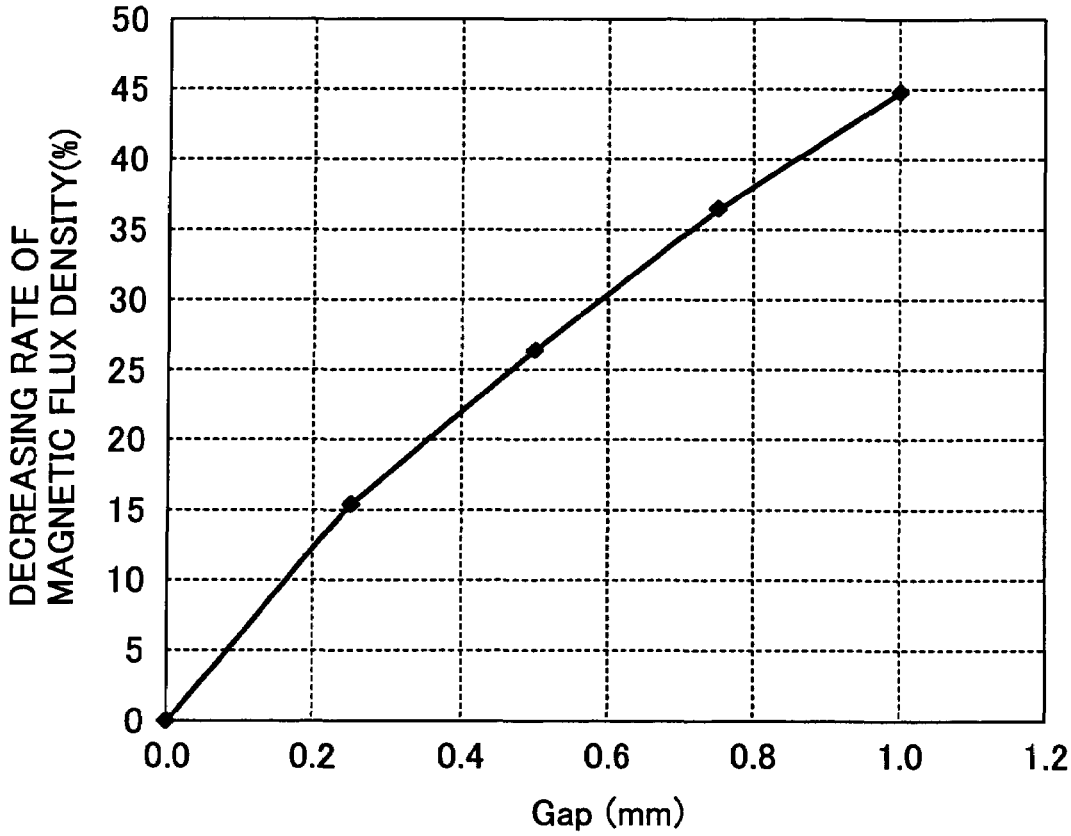
FIG. 17 is a graph illustrating the decreasing rate of magnetic flux density of the developing sleeve used for the second example of the developing method of the present invention.

FIG. 17 is a graph showing the relationship between the gap (mm) and the decreasing rate (%) of the magnetic flux density (100×(Mmax−M)/Mmax) wherein Mmax represents the peak magnetic flux density and M represents the magnetic flux at a point). In this case, the attenuation rate of the magnetic flux density (i.e., the decreasing rate of the magnetic flux density at a point apart from the surface of the developing sleeve by 1 mm) is 45%.

By changing the main pole angle and the ratio vs/vp of the linear velocity (vs) of the developing sleeve to the linear velocity (vp) of the photoreceptor (i.e., Examples 4 and 5 and Comparative Examples 3 and 4), the ratio (Anc/At), the percentage of the areas satisfying $S \leqq \pi (Dw/2)^2$, the percentage of the areas satisfying $S \leqq 1.5\pi (Dw/2)^2$, and the ratio (Avc/vs) were changed. The granularity and dot reproducibility of the resultant images were evaluated as follows.

(1) Granularity (GRA)

The granularities of the patches having a brightness of from 40 to 80% were averaged to obtain an average value, which is the granularity of the image. The granularity is graded as follows:

○: The average granularity is less than 0.46.

×: The average granularity is not less than 0.46.

(2) Dot Reproducibility (DOT)

Isolated dot images recorded at a density of 600 dpi were printed. The dot images were visually observed to determine whether the dot images have omissions (i.e., non-printed dots). The dot reproducibility was graded as follows.

○: There are not greater than two non-printed dots.

Δ: There are from 3 to 10 non-printed dots.

×: There are not less than 11 non-printed dots.

The results are shown in Table 2. In Table 2, the main pole angle is changed from 0 to 7° in the direction opposite to the rotation direction of the developing sleeve.

TABLE 2

| | main pole angle (°) | vs/vp | Anc/At (%) | PER 1* (%) | PER 5*2 (%) | Avc/vs | GRA | DOT |
|---|---|---|---|---|---|---|---|---|
| Ex. 4 | 3 | 2 | 46.8 | 27.7 | 49.1 | 0.87 | ○ | ○ |
| Ex. 5 | 6 | 2 | 34.4 | 35.6 | 60.2 | 0.31 | ○ | ○ |
| Comp. Ex. 3 | 7 | 2 | 29.8 | 40.1 | 63.3 | 0.28 | ○ | Δ |
| Comp. Ex. 4 | 0 | 1.5 | 65.3 | 0.0 | 4.2 | 1.46 | X | X |

PER 1*: Percentage of the areas satisfying $S \leqq \pi (Dw/2)^2$

PER 5*2: Percentage of the areas satisfying $S \leqq 1.5\pi (Dw/2)^2$

It is clear from Table 2 that when a DC voltage is used as a developing bias, high quality images with little granularity and good reproducibility can be produced if the ratio (Anc/At) is small (i.e., not greater than 50%).

The present inventor has studied the relationship between the sizes of the carrier-noncontact regions in the longitudinal direction of the developing sleeve and the rotation direction of the developing sleeve and the granularity of the resultant images. As a result of the study, it is found that when the length of the carrier-noncontact regions in the rotation direction of the developing sleeve is short, high quality images with little granularity can be produced.

The ratio (Anc/At) was determined using an observation system having such a configuration as illustrated in FIG. 2. Specifically, a glass drum having a diameter of 90 mm was used as a substitute for a photoreceptor. The tip portion of the magnetic brushes observed with the observation system was enlarged with a stereomicroscope SZ60 from Olympus Optical Co., Ltd. and the behavior of the developer was caught by a high speed camera ULTIMA II from Photron Ltd. The developing regions in Example 5 and Comparative Example 4, which were caught by the camera, are illustrated in FIGS. 18 and 19, respectively.

Figure 18:
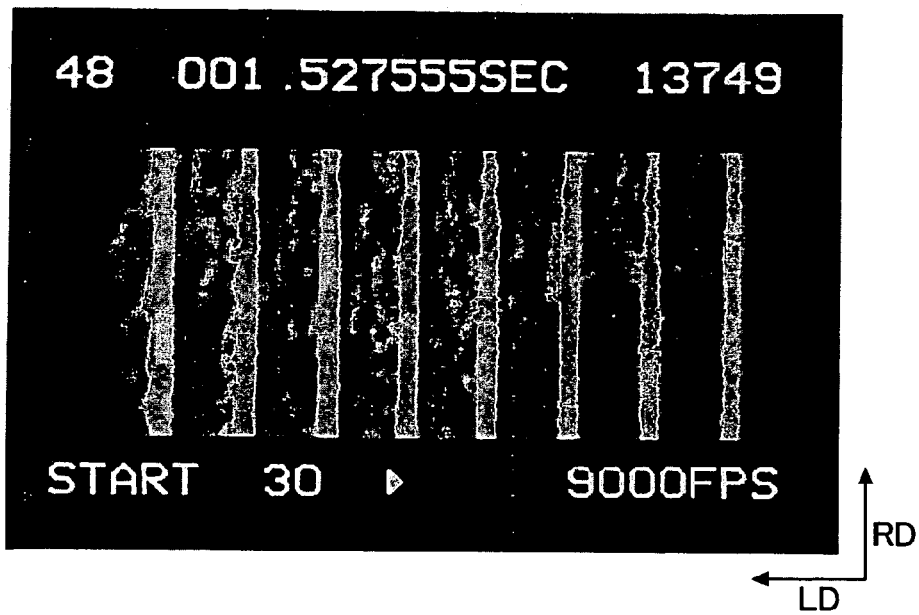
FIG. 18 is a photograph showing the behavior of the developer in the developing region in Example 5.
Figure 19:
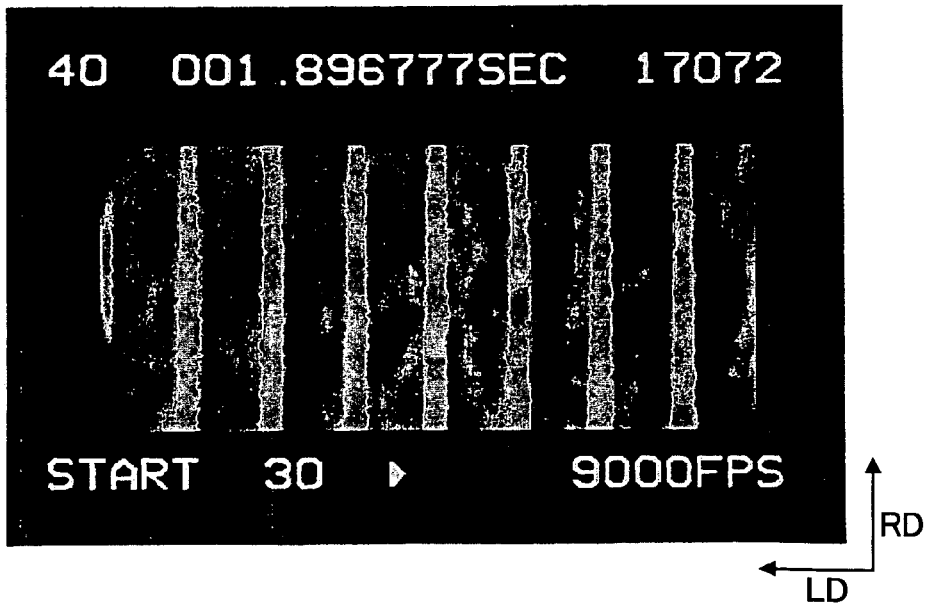
FIG. 19 is a photograph showing the behavior of the developer in the developing region in Comparative Example 4.

It is clear from FIGS. 18 and 19 that the area of the carrier-contact regions, which correspond to spotted white portions in the photographs, is greater in FIG. 18 (i.e., Example 5) than that in FIG. 19 (i.e., Comparative Example 4). In contrast, the area of the carrier-noncontact regions, which correspond to black portions in the photographs, is less in FIG. 18 (i.e., Example 5) than that in FIG. 19 (i.e., Comparative Example 4). In this regard, the dimension of the region caught by the camera is about 2 mm in the longitudinal direction of the developing sleeve and about 1 mm in the rotation direction of the developing sleeve. The longitudinal directions and rotation direction are represented as characters LD and RD in FIGS. 18 and 19.

Figure 20:
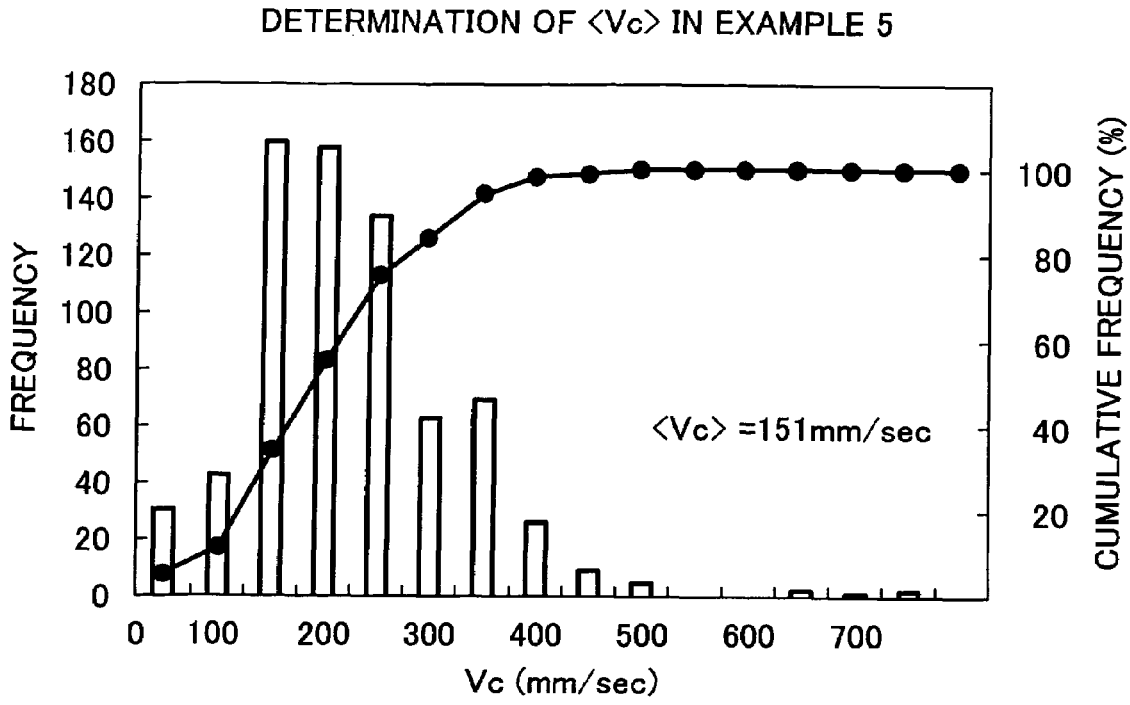
FIG. 20 is a graph illustrating the experimental data of the moving velocity of the carrier particles in Example 5.
Figure 21:
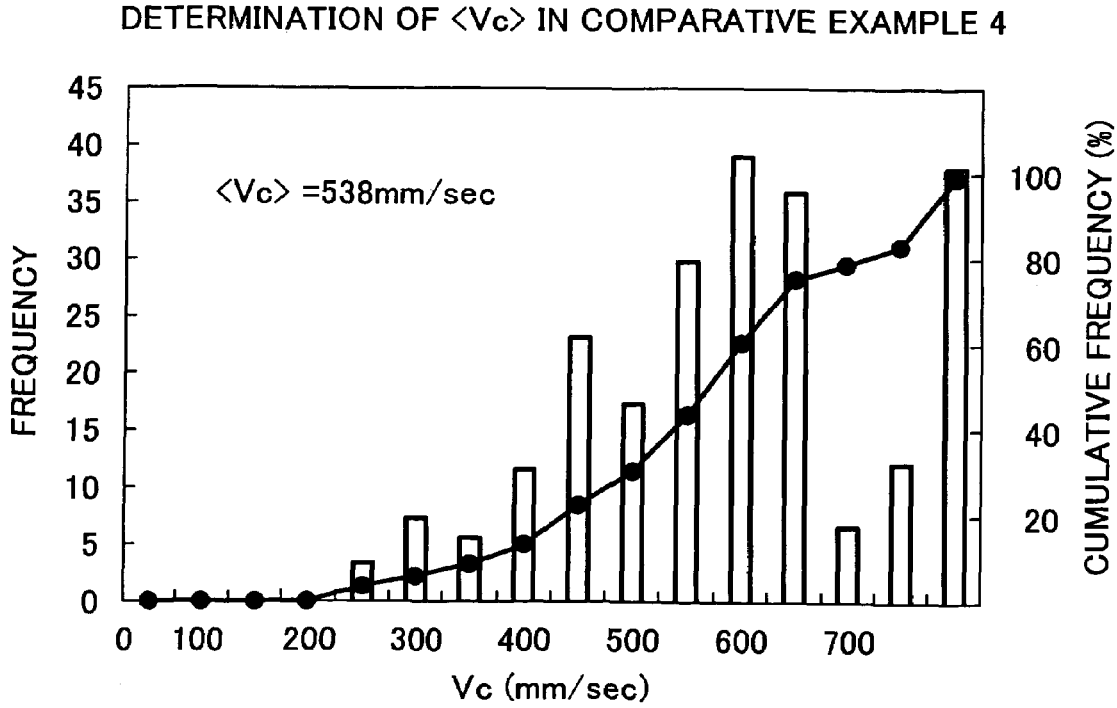
FIG. 21 is a graph illustrating the experimental data of the moving velocity of the carrier particles in Comparative Example 4.

In addition, the average moving velocity (Avc) of the magnetic carrier particles contacting the photoreceptor was determined by a PTV method. FIGS. 20 and 21 are graphs illustrating the experimental data of the moving velocity of the carrier particles in Example 5 and Comparative Example 4, respectively. In FIGS. 20 and 21, the moving velocity of carrier particles is plotted on the horizontal axis and the number (frequency) of the carrier particles having a moving velocity, which is represented as a bar is plotted on the vertical axis. In addition, the cumulative curve of the frequency of carrier particles is also illustrated in FIGS. 20 and 21.

In this image forming apparatus, an alternate electric field having a DC component of −420V and an amplitude of 900V was applied as the developing bias.

The produced images were evaluated with respect to the granularity and dot reproducibility. The results are shown in Table 3.

TABLE 3

| | main pole angle (°) | vs/vp | Anc/At (%) | PER 1* (%) | PER 5*[2] (%) | Avc/vs | GRA | DOT |
|---|---|---|---|---|---|---|---|---|
| Ex. 6 | 3 | 2 | 48.2 | 26.2 | 46.8 | 0.92 | ○ | ○ |
| Ex. 7 | 6 | 2 | 32.9 | 37.1 | 58.1 | 0.35 | ○ | ○ |
| Comp. Ex. 5 | 0 | 1.1 | 59.3 | 0.0 | 4.2 | 1.48 | X | X |

PER 1*: Percentage of the areas satisfying $S \leqq \pi (Dw/2)^2$
PER 5*[2]: Percentage of the areas satisfying $S \leqq 1.5 \pi (Dw/2)^2$ It is clear from Table 3 that similarly to the above-mentioned case where the direct voltage is applied as the developing bias, high quality images with little granularity and good reproducibility can be produced if the ratio (Anc/At) is small (i.e., not greater than 50%). The produced images are superior to those in the above-mentioned case where the direct voltage is applied as the developing bias in view of granularity. Even when the linear velocity ratio is small (i.e., 2), high quality images can be produced.

This document claims priority and contains subject matter related to Japanese Patent Applications Nos. 2004-271710, 2005-79428 and 2005-259434, filed on Sep. 17, 2004, Mar. 18, 2005 and Sep. 7, 2005, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A developing method comprising:

forming a magnetic brush of a two component developer comprising a toner and a magnetic carrier so as to be borne on a surface of a developer bearing member by means of magnetic poles of a magnet fixed in the developer bearing member; and developing an electrostatic latent image on a surface of an image bearing member with the magnetic brush in a developing region, in which the image bearing member and the developer bearing member are opposed to each other, while moving the image bearing member, and moving the magnetic brush by moving the developer bearing member without moving the magnet to form a toner image on the surface of the image bearing member, wherein the developing method satisfies the following relationships (1) and (2):

$$0.30 \leqq A_{nc}/A_t \leqq 0.70 \quad (1)$$

wherein $A_t$ represents an area of a development portion of the photoreceptor in the developing region, and $A_{nc}$ represents an area of a carrier-noncontact portion of the photoreceptor in the development portion thereof with which the magnetic brush is not contacted when the development portion has no latent image, and $$0.8 \leqq Avc/vs \leqq 1.1 \quad (2)$$

wherein Avc represents an average moving velocity of carrier particles of the magnetic carrier in the magnetic brush, said carrier particles being contacted with the image bearing member, and vs represents a moving velocity of the surface of the developer bearing member.

2. The method according to claim 1, wherein the carrier-noncontact portion includes separated plural regions and a ratio of a number of regions having an area not greater than $\pi(Dw/2)^2$ to a total number of the separated plural regions is not less than 0.10, wherein Dw represents a weight average particle diameter of the magnetic carrier.

3. The method according to claim 1, wherein the carrier-noncontact portion includes separated plural regions and a ratio of a number of regions having an area not greater than 5 $\pi(Dw/2)^2$ to a total number of the separated plural regions is not less than 0.30, wherein Dw represents a weight average particle diameter of the carrier.

4. The method according to claim 1, wherein not less than 90% in number of the carrier particles contacted with the image bearing member satisfies the following relationship (3):

$$vp \leqq vc \leqq 2vs \quad (3)$$

wherein vp represents a moving velocity of the surface of the image bearing member, vc represents a moving velocity of the carrier particles contacting the image bearing member, and vs represents the moving velocity of the surface of the developer bearing member.

5. The method according to claim 1, wherein not less than 80% in number of the carrier particles contacted with the image bearing member satisfies the following relationship (4):

$$0.625 \leqq vc/vs \leqq 1.5 \quad (4)$$

wherein vp represents a moving velocity of the surface of the image bearing member, vc represents a moving velocity of the carrier particles contacting the image bearing member, and vs represents the moving velocity of the surface of the developer bearing member.

6. The method according to claim 1, wherein the magnetic carrier comprises a magnetic core material and a resin layer located on a surface of the magnetic core material, and has a weight average particle diameter of from 25 to 45 μm.

7. The method according to claim 1, wherein the magnetic carrier includes particles having a particle diameter less than 44 μm in an amount of not less than 70% by weight, particles having a particle diameter not less than 62 μm in an amount of less than 1% by weight, and particles having a particle diameter less than 22 μm in an amount of not greater than 7% by weight.

8. The method according to claim 1, wherein the magnetic carrier has a magnetization of from 70 $A \cdot m^2/kg$ to 100 $A \cdot m^2/kg$ at a magnetic field of $1 \times 10^6/4\pi$ [A/m].

9. The method according to claim 1, wherein the magnet has a magnetic pole facing the developing region and the magnetic pole has a magnetic flux density of from 60 mT to 120 mT in a normal line direction at a surface of the magnetic pole.

10. The method according to claim 1, wherein the magnet has a magnetic pole facing the developing region and the magnet is arranged such that a normal line of the magnetic pole is different from a common normal line of the image bearing member and the developer bearing member by an angle of from 3° to 7° in a direction opposite to the moving direction of the image bearing member.

11. The method according to claim 1, wherein a ratio (vs/vp) of the moving velocity (vs) of the surface of the developer bearing member to a moving velocity (vp) of the surface of the image bearing member is from 1.5 to 2.5.

12. The method according to claim 1, wherein the developing is performed while applying either a direct electric field or an alternate electric field to the developer bearing member.

13. The method according to claim 1, wherein the developer bearing member bears the two component developer in an amount of from 40 $mg/cm^2$ to 80 $mg/cm^2$ in the developing region.

14. The method according to claim 1, wherein the two component developer includes the toner in an amount of from 5.0% by weight to 9.0% by weight based on a total weight of the two component developer, and wherein the toner has an average charge quantity of from 15 μC/g to 60 μC/g in absolute value.

15. The method according to claim 1, wherein the toner has a weight average particle diameter (Dw) of from 4.5 to 8.0 μm, and a ratio (Dw/Dn) of the weight average particle diameter (Dw) to a number average particle diameter (Dn) of the toner is from 1.0 to 1.2.

16. A developing method comprising:

forming a magnetic brush of a two component developer comprising a toner and a magnetic carrier so as to be borne on a surface of a developer bearing member by means of magnetic poles of a magnet fixed inside the developer bearing member; and developing an electrostatic latent image on a surface of an image bearing member with the magnetic brush in a developing region, in which the image bearing member and the developer bearing member are opposed to each other, while moving the image bearing member, and moving the magnetic brush by moving the developer bearing member without moving the magnet to form a toner image on the surface of the image bearing member, wherein the developing method satisfies the following relationships (5) and (6):

$$A_{nc}/A_t \leqq 0.50 \quad (5)$$

wherein $A_t$ represents an area of a development portion of the photoreceptor in the developing region, and $A_{nc}$ represents an area of a carrier-noncontact portion of the photoreceptor in the development portion with which the magnetic brush is not contacted when the development portion has no latent image, and $$0.3 \leqq Avc/vs \leqq 1.1 \quad (6)$$

wherein Avc represents an average moving velocity of carrier particles of the magnetic carrier in the magnetic brush, said carrier particles being contacted with the image bearing member, and vs represents a moving velocity of the surface of the developer bearing member.

17. The method according to claim 16, wherein the carrier-noncontact portion includes separated plural regions and a ratio of a number of regions having an area not greater than $\pi(Dw/2)^2$ to a total number of the separated plural regions is not less than 0.25, wherein Dw represents a weight average particle diameter of the carrier.

18. The method according to claim 16, wherein the carrier-noncontact portion includes separated plural regions and a ratio of a number of regions having an area not greater than $1.5\pi(Dw/2)^2$ to a total number of the separated plural regions is not less than 0.45, wherein Dw represents a weight average particle diameter of the carrier.

19. The method according to claim 16, wherein the developing is performed while applying either a direct electric field or an alternate electric field to the developer bearing member.

20. The method according to claim 19, wherein a ratio (vs/vp) of a moving velocity (vs) of the surface of the developer bearing member to the moving velocity (vp) of the surface of the image bearing member is from 1.2 to 3 when a dielectric electric field is applied, and the ratio (vs/vp) is from 2 to 3 when an alternate electric field is applied.

21. The method according to claim 16, wherein the developer bearing member bears the two component developer in an amount of from 20 $mg/cm^2$ to 60 $mg/cm^2$ in the developing region.

22. The method according to claim 16, wherein the magnetic carrier has a weight average particle diameter of from 25 to 45 μm.

23. The method according to claim 16, wherein the magnetic carrier includes particles having a particle diameter less than 44 μm in an amount of not less than 70% by weight, particles having a particle diameter not less than 62 μm in an amount of less than 1% by weight, and particles having a particle diameter less than 22 μm in an amount of not greater than 7% by weight.

24. The method according to claim 16, wherein the magnetic carrier has a magnetization of not less than 76 $A \cdot m^2/kg$ at a magnetic field of $1 \times 10^6/4\pi$ [A/m].

25. The method according to claim 16, wherein the magnetic carrier has a volume resistivity of not less than $1\times10^{12}$ Ω·cm.

26. The method according to claim 16, wherein the toner comprises a urea-modified polyester resin.

27. The method according to claim 16, wherein the toner has a weight average particle diameter of from 4 to 8 μm, and a ratio (Dw/Dn) of the weight average particle diameter (Dw) to a number average particle diameter (Dn) of the toner is from 1 to 1.25.

28. The method according to claim 16, wherein the toner has an average circularity of not less than 0.9 and less than 1.0.

29. The method according to claim 16, wherein the magnet has a magnetic pole facing the developing region and the magnetic pole has a magnetic flux density of from 60 mT to 120 mT in a normal line direction at a surface of the magnetic pole.

30. The method according to claim 16, wherein the magnet has a magnetic pole facing the developing region and the magnet is arranged such that a normal line of the magnetic pole is different from a common normal line of the image bearing member and the developer bearing member by an angle of from 3° to 7° in a direction opposite to the moving direction of the image bearing member.

31. A developing device comprising:

a two component developer comprising a toner and a magnetic carrier;

a developer bearing member configured develop an electrostatic latent image on surface of an image bearing member with the developer in a developing region to form a toner image on the image bearing member; and a magnet which is located in the image bearing member while fixed and which attracts the developer such that the two component developer is borne on a surface of the developer bearing member, wherein the image bearing member and the developer bearing member move while being opposed to each other in the developing region, wherein the developing device satisfies a combination of the following relationships (1) and (2):

$$0.30 \leqq A_{nc}/A_t \leqq 0.70 \quad (1)$$

wherein $A_t$ represents an area of a development portion of the photoreceptor in the developing region, and $A_{nc}$ represents an area of a carrier-noncontact portion of the photoreceptor in the development portion with which the magnetic brush is not contacted when the development portion has no latent image, and $$0.8 \leqq Avc/vs \leqq 1.1 \quad (2)$$

wherein Avc represents an average moving velocity of carrier particles of the magnetic carrier in the magnetic brush, said carrier particles being contacted with the image bearing member, and vs represents a moving velocity of the surface of the developer bearing member; or a combination of the following relationships (5) and (6);

$$A_{nc}/A_t \leqq 0.50 \quad (5), \text{ and}$$

$$0.3 \leqq Avc/vs \leqq 1.1 \quad (6).$$

32. An image forming apparatus comprising:

an image bearing member configured to bear an electrostatic latent image thereon; and a developing device configured to develop the electrostatic latent image with a developer comprising a toner and a magnetic carrier to form a toner image on the image bearing member, wherein the developing device is the developing device according to claim 31.

33. A process cartridge comprising:

an image bearing member configured to bear an electrostatic latent image thereon; and a developing device configured to develop the electrostatic latent image with a developer comprising a toner and a magnetic carrier to form a toner image on the image bearing member, wherein the developing device is the developing device according to claim 31, and wherein the process cartridge is detachably attached to an image forming apparatus.

* * * * *